US011783775B2

(12) United States Patent
Kodama

(10) Patent No.: US 11,783,775 B2
(45) Date of Patent: Oct. 10, 2023

(54) ELECTRO-OPTICAL DEVICE, DRIVING METHOD FOR ELECTRO-OPTICAL DEVICE, AND ELECTRONIC APPARATUS

(71) Applicant: SEIKO EPSON CORPORATION, Tokyo (JP)

(72) Inventor: Takumi Kodama, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/956,262

(22) Filed: Sep. 29, 2022

(65) Prior Publication Data

US 2023/0101721 A1 Mar. 30, 2023

(30) Foreign Application Priority Data

Sep. 30, 2021 (JP) ..... 2021-161077

(51) Int. Cl.
*G09G 3/3233* (2016.01)

(52) U.S. Cl.
CPC ... *G09G 3/3233* (2013.01); *G09G 2300/0819* (2013.01); *G09G 2300/0828* (2013.01); *G09G 2300/0842* (2013.01); *G09G 2310/0286* (2013.01); *G09G 2310/0291* (2013.01); *G09G 2310/08* (2013.01); *G09G 2320/0626* (2013.01)

(58) Field of Classification Search
CPC ..... G09G 3/3233; G09G 2300/0819; G09G 2300/0828; G09G 2300/0842; G09G 2310/0286; G09G 2310/0291; G09G 2310/08; G09G 2320/0626
USPC ..... 345/76
See application file for complete search history.

(56) References Cited

U.S. PATENT DOCUMENTS

2007/0164959 A1* 7/2007 Childs ..... G09G 3/3233 345/92
2009/0174699 A1* 7/2009 Fish ..... G09G 3/3233 345/82
2010/0253666 A1* 10/2010 Yamamoto ..... H05B 47/10 345/211
2013/0278167 A1 10/2013 Yamamoto
2014/0192037 A1* 7/2014 Chung ..... G09G 3/2022 345/82
2014/0204067 A1* 7/2014 Gupta ..... G09G 3/3291 345/76

(Continued)

FOREIGN PATENT DOCUMENTS

JP 2005-189382 A 7/2005
JP 2010-243560 A 10/2010

(Continued)

*Primary Examiner* — Tom V Sheng
(74) *Attorney, Agent, or Firm* — Oliff PLC

(57) ABSTRACT

A pixel circuit provided corresponding to a scanning line and a data line includes a transistor and an OLED that is an example of a light emitting element. In a compensation period, a gate node and a drain node of the transistor are electrically coupled, and the gate node of the transistor has a voltage corresponding to a threshold voltage. In a writing period, the gate node of the transistor is changed from the voltage corresponding to the threshold voltage by a voltage corresponding to luminance of the light emitting element, and in a discharge period, a reset voltage is applied to a drain node of the transistor via a data line.

8 Claims, 24 Drawing Sheets

(56) References Cited

U.S. PATENT DOCUMENTS

2015/0348462 A1* 12/2015 Ma ..... G09G 3/3233 345/78
2016/0055797 A1* 2/2016 Tan ..... G09G 3/3258 345/206
2016/0071458 A1* 3/2016 Tan ..... G09G 3/3233 345/82
2016/0246409 A1* 8/2016 Yang ..... G09G 3/3225
2016/0247449 A1* 8/2016 Yin ..... G09G 3/3258
2016/0253963 A1* 9/2016 Yang ..... G09G 3/3233 345/211
2017/0039954 A1* 2/2017 Sun ..... G09G 3/3233
2018/0261155 A1* 9/2018 Ota ..... H10K 50/82
2018/0268760 A1* 9/2018 Chen ..... G09G 3/3266
2019/0180688 A1* 6/2019 Yang ..... G09G 3/3233
2019/0189054 A1* 6/2019 Yang ..... G09G 3/3258
2019/0340979 A1* 11/2019 Yang ..... G09G 3/3233
2019/0371238 A1* 12/2019 Gao ..... H10K 59/131
2020/0090579 A1* 3/2020 Chen ..... G09G 3/32
2020/0098316 A1* 3/2020 Yokoyama ..... G09G 3/3266
2020/0265786 A1* 8/2020 Li ..... G09G 3/3266
2021/0335278 A1* 10/2021 Song ..... G09G 3/3258
2022/0051621 A1* 2/2022 Feng ..... G09G 3/3233
2022/0123082 A1* 4/2022 He ..... H10K 59/1213
2022/0277696 A1* 9/2022 Xiong ..... G09G 3/3233
2022/0301506 A1* 9/2022 Zhang ..... G09G 3/3233
2022/0310009 A1* 9/2022 Wang ..... G09G 3/3233
2022/0319438 A1* 10/2022 Sun ..... H10K 59/00
2023/0010212 A1* 1/2023 Park ..... G09G 3/3233
2023/0013661 A1* 1/2023 Beard ..... G09G 3/3233
2023/0044565 A1* 2/2023 Zhang ..... G09G 3/20
2023/0057970 A1* 2/2023 Yamamoto ..... G09G 3/3283
2023/0097941 A1* 3/2023 Sang ..... G09G 3/3258 345/204

FOREIGN PATENT DOCUMENTS

JP 2010-262251 A 11/2010
JP 2018-151506 A 9/2018
JP 2021-015211 A 2/2021

* cited by examiner

ELECTRO-OPTICAL DEVICE, DRIVING METHOD FOR ELECTRO-OPTICAL DEVICE, AND ELECTRONIC APPARATUS

The present application is based on, and claims priority from JP Application Serial Number 2021-161077, filed Sep. 30, 2021, the disclosure of which is hereby incorporated by reference herein in its entirety.

BACKGROUND

1. Technical Field

The present disclosure relates to an electro-optical device, a driving method for the electro-optical device, and an electronic apparatus.

2. Related Art

Electro-optical devices using light emitting elements such as an OLED are known. OLED is an abbreviation for Organic Light Emitting Diode. An electro-optical device includes a pixel circuit, and the pixel circuit is provided corresponding to each pixel of an image to be displayed, and includes a light emitting element, a transistor that supplies a current corresponding to a gradation level to the light emitting element, and the like.

When the electro-optical device is miniaturized, capacitance is parasitic on each part of the electro-optical device. When the capacitance is parasitic on a drain node of a transistor for supplying a current to a light emitting element, a charge remaining in the parasitic capacitance flows to the light emitting element, and thus a reduction in display quality is caused. Therefore, a technique for resetting the charge remaining in the drain node of the transistor before supplying a current to the light emitting element has been proposed (refer to, for example, JP-A-2010-243560).

However, in the technique described in JP-A-2010-243560, it is necessary to extend a feed line for supplying a reset voltage to the drain node of the transistor that supplies a current to a light emitting element to the pixel circuit, and the configuration is complicated. When the configuration becomes complicated, a display size increases, the number of laminated wiring layers increases, cost increases, and a yield decreases.

Therefore, an object of the present disclosure is to provide a technical means to suppress a reduction in display quality caused by a charge remaining in a drain node of a transistor that supplies a current to a light emitting element while avoiding complexity of a configuration.

SUMMARY

An electro-optical device according to an aspect of the present disclosure includes a pixel circuit provided corresponding to a scanning line and a data line; and a first transistor and a light emitting element included in the pixel circuit, wherein the first transistor is configured to supply a current corresponding to a voltage between a gate node of the first transistor and a source node of the first transistor to the light emitting element, a horizontal scanning period includes a compensation period, a writing period, and a discharge period in this order, in the compensation period, the gate node of the first transistor and a drain node of the first transistor are electrically coupled, and a voltage of the gate node of the first transistor is set to a voltage corresponding to a threshold voltage of the first transistor, in the writing period, the voltage of the gate node of the first transistor is changed from the voltage corresponding to the threshold voltage by a voltage corresponding to luminance of the light emitting element, in the discharge period, a reset voltage is applied to the drain node of the first transistor via the data line, and in a light emission period after the discharge period, the first transistor supplies the current corresponding to the voltage between the gate node of the first transistor and the source node of the first transistor to the light emitting element.

DESCRIPTION OF EMBODIMENTS

Hereinafter, an electro-optical device according to an embodiment of the present disclosure will be described with reference to the accompanying drawings. In each of the drawings, a dimension and a scale of each part are appropriately different from actual ones. Moreover, embodiments described below are suitable specific examples of the disclosure, and various technically preferable limitations are applied, but the scope of the disclosure is not limited to these modes unless it is specifically described in the following description to limit the present disclosure.

First Embodiment

Figure 1:
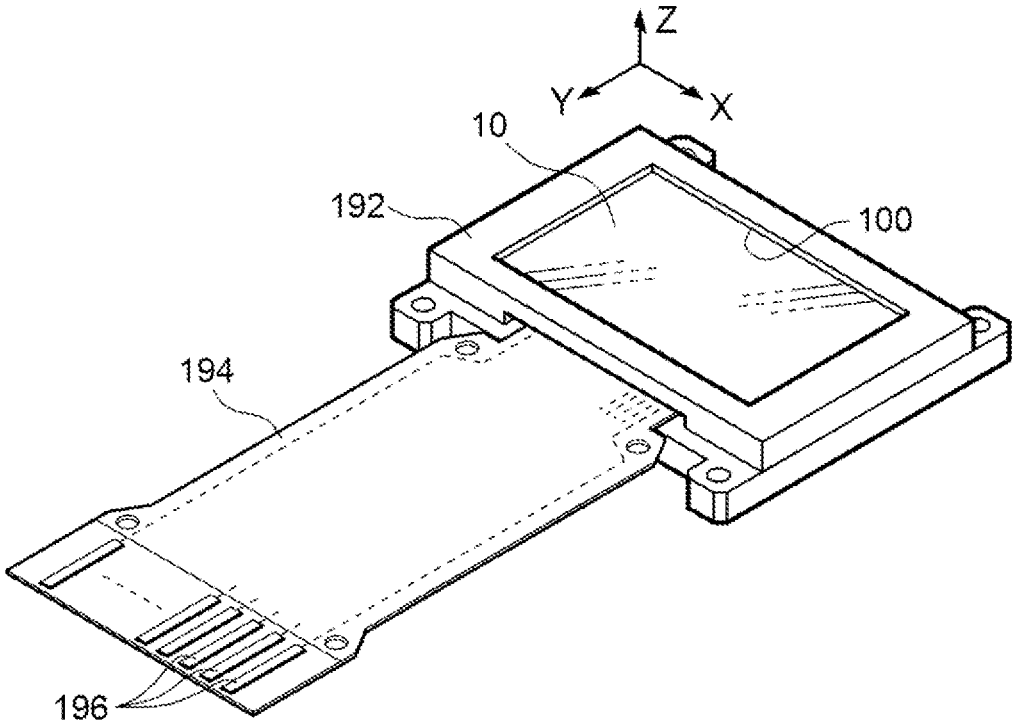
FIG. 1 is a perspective view illustrating an electro-optical device according to a first embodiment.

FIG. 1 is a perspective view illustrating a configuration of an electro-optical device 10 according to a first embodiment. The electro-optical device 10 is a micro display panel configured to display an image in a head-mounted display, for example. The electro-optical device 10 includes a plurality of pixel circuits, a drive circuit configured to drive the pixel circuits, and the like. The pixel circuit and the drive circuit are integrated into a semiconductor substrate. The semiconductor substrate is typically a silicon substrate, but may be another semiconductor substrate.

The electro-optical device 10 is accommodated in a frame-shaped case 192 that opens in a display region 100. One end of an FPC substrate 194 is coupled to the electro-optical device 10. FPC is an abbreviation for "flexible printed circuit". A plurality of terminals 196 for coupling a host device (not shown) are provided at the other end of the FPC substrate 194. When the plurality of terminals 196 are coupled to the host device, video data, synchronization signals, and the like are supplied from the host device to the electro-optical device 10 via the FPC substrate 194.

In the drawing, an X direction is a direction in which a scanning line extends in the electro-optical device 10, and indicates a horizontal direction on a display screen, and a Y direction is a direction in which a data line extends, and indicates a vertical direction on the display screen. A two-dimensional plane defined in the X direction and the Y direction is a substrate surface of a semiconductor substrate. A Z direction is perpendicular to the X direction and the Y direction and indicates an emission direction of light emitted from a light emitting element.

Figure 2:
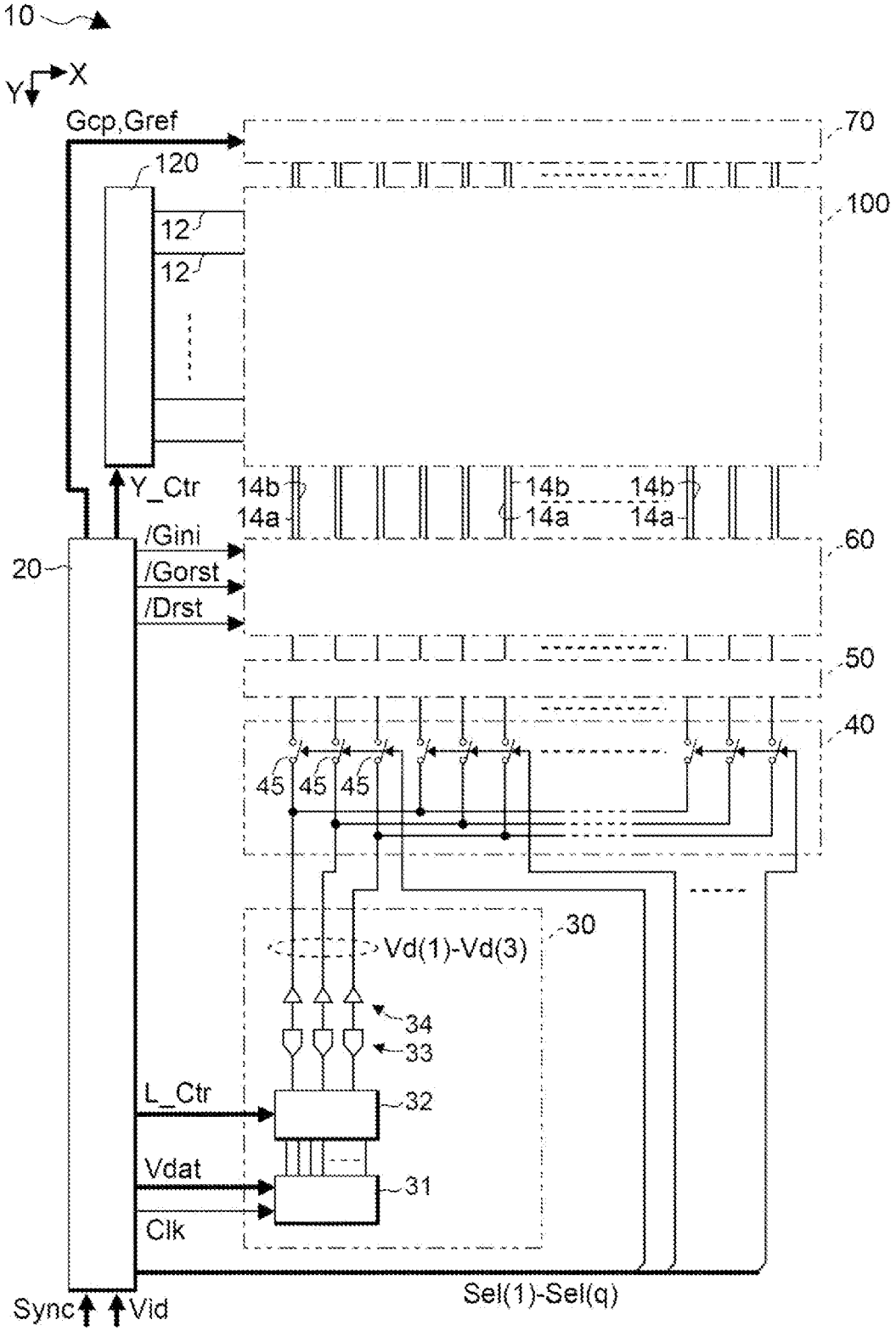
FIG. 2 is a block diagram illustrating an electrical configuration of an electro-optical device.

FIG. 2 is a block diagram illustrating an electrical configuration of the electro-optical device 10. As illustrated in the drawing, the electro-optical device 10 includes a control circuit 20, a data signal output circuit 30, a switch group 40, a capacitance element group 50, an initialization circuit 60, an auxiliary circuit 70, a display region 100, and a scanning line drive circuit 120.

In the display region 100, m rows of scanning lines 12 are provided in the X direction in the drawing, and (3q) columns of data lines 14*b* are provided in the Y direction to be electrically insulated from each of the scanning lines 12.

Each of m and q is an integer equal to or greater than 2. Further, pixel circuits are provided corresponding to intersections between the m rows of scanning lines 12 and the (3q) columns of data lines 14*b*. Thus, the pixel circuits are arranged in a matrix pattern including m rows and (3q) columns.

The control circuit 20 controls each part on the basis of video data Vid and a synchronization signal Sync output from the host device. The video data Vid supplied in synchronization with the synchronization signal Sync specifies a gradation level of a pixel in an image to be displayed in 8 bits, for example, for each of R, G, and B. In addition, the synchronization signal Sync includes a vertical synchronization signal that indicates a start of vertical scanning of the video data Vid, a horizontal synchronization signal that indicates a start of horizontal scanning, and a dot clock signal that indicates a timing of one pixel of the video data.

The control circuit 20 generates control signals Gcp, Gref, y_Ctr, /Gini, /Gorst, /Drst, L_Ctr, Sel(1) to Sel(q) and a clock signal Clk to control each part. Although omitted in FIG. 2, the control circuit 20 outputs a control signal /Gcp in the relationship of logical inversion to the control signal Gcp, a control signal /Gref in the relationship of logical inversion to the control signal Gref and control signals/Sel (1) to/Sel(q) in the relationship of logical inversion to the Sel(1) to Sel(q).

The control signals are logical signals. The leading "/" in a code of each of the control signals indicates that the control signal is negative logic, becomes active at an L level, and becomes non-active at an H level. The control signals without a leading "/" indicate that the control signal is positive logic, becomes non-active at the L level, and becomes active at the H level.

In addition, the L level is 0 V, that is a reference of zero voltage, and the H level is, for example, 6.0 V in the control signal.

In the description, a voltage at a certain point refers to a difference between a ground potential which is the L level of the logic signal, and a potential at the point, unless otherwise specified. An example of a case that will be described is a threshold voltage of a transistor and a holding voltage of a capacitance element, which will be described below. The threshold voltage of the transistor is a potential difference between a gate node and a source node at which a current starts to flow between the source node and a drain node in the transistor, and the holding voltage of the capacitance element is a potential difference between one end and the other end of the capacitance element.

In the first embodiment, a pixel of an image to be displayed and the pixel circuit in the display region 100 correspond one-to-one. A gradation level indicated by the video data Vid supplied from the host device and characteristics of luminance do not necessarily match each other in the OLED (the light emitting element) in the pixel circuit. Thus, in order to make the OLED emit light with a luminance corresponding to the gradation level indicated by the video data Vid, the control circuit 20 up-converts 8 bits of the video data Vid to, for example, 10 bits and outputs converted video data Vdat. Thus, the 10-bit video data Vdat is data corresponding to the gradation level specified by the video data Vid.

For the up-conversion, a look-up table in which a corresponding relationship between 8 bits of the video data Vid that is an input and 10 bits of the video data Vdat that is an output is stored in advance is used.

The scanning line drive circuit 120 is a circuit for driving the pixel circuit arranged in m rows and (3q) columns in units of one row in accordance with the control signal Y_Ctr.

The data signal output circuit 30 outputs a data signal toward the data line 14*b*. Specifically, the data signal output circuit 30 outputs a data signal having a voltage corresponding to the gradation level of the pixel represented by the pixel circuit.

In the first embodiment, voltage amplitude of the data signal output from the data signal output circuit 30 is compressed and supplied to the data line 14*b*. Therefore, the data signal after compression is also a voltage corresponding to the gradation level of the pixel.

Furthermore, the data signal output circuit 30 also has a function of parallel-converting serially supplied video data Vdat into a plurality of phases (in this example, "3" phases corresponding to the number of data lines 14 constituting a group) and outputting the converted video data.

The data signal output circuit 30 includes a shift register 31, a latch circuit 32, a D/A conversion circuit group 33, and an amplifier group 34.

The shift register 31 sequentially transmits the video data Vdat serially supplied in synchronization with the clock signal Clk and stores one line, that is, (3q) in terms of the number of pixel circuits.

The latch circuit 32 latches the (3q) video data Vdat stored in the shift register 31 in accordance with the control signal L_Ctr, parallel-converts the latched video data Vdat into three phases in accordance with the control signal L_Ctr and then outputs the converted video data.

The digital-to analog (D/A) conversion circuit group 33 includes three D/A converters. The three-phase video data Vdat output from the latch circuit 32 is converted to an analog signal by the three D/A converters.

The amplifier group 34 includes three amplifiers. The three-phase analog signal output from the D/A conversion circuit group 33 is amplified by the three amplifiers and is then output as data signals Vd(1), Vd(2), and Vd(3).

The control circuit 20 outputs the control signals Sel(1) to Sel(q) that sequentially and exclusively reach an H level in a compensation period prior to a writing period as will be described below.

Figure 3:
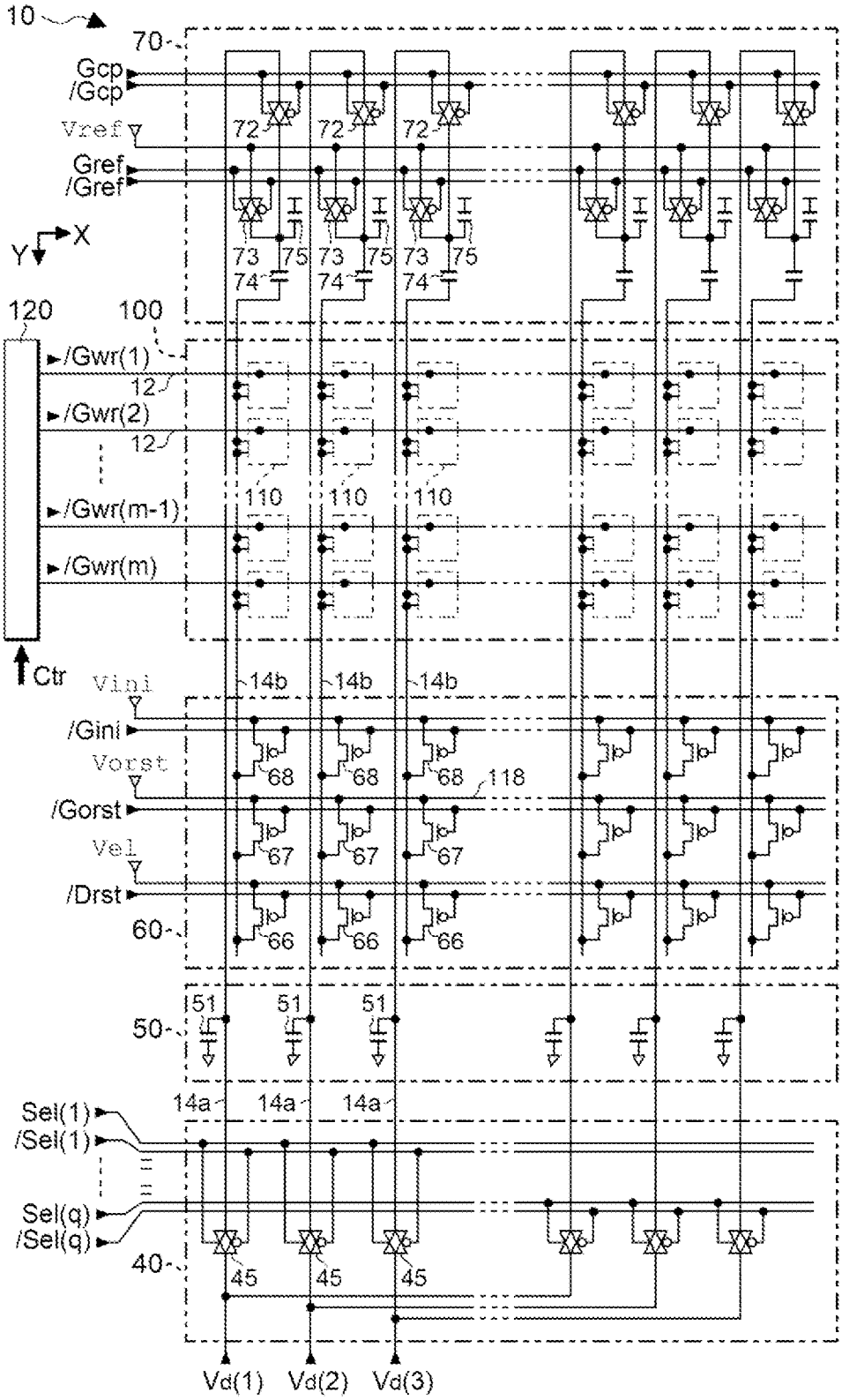
FIG. 3 is a circuit diagram illustrating a part of the electro-optical device.

FIG. 3 is a circuit diagram illustrating a part of the electro-optical device 10, and in particular, is a circuit diagram illustrating configurations of the switch group 40, the capacitance element group 50, the initialization circuit 60, the auxiliary circuit 70, and the display region 100.

In the display region 100, pixel circuits 110 corresponding to pixels of an image to be displayed are arranged in a matrix in m rows and (3q) columns. In order to distinguish the rows in the matrix array, the rows may be referred to as 1, 2, 3, . . . , (m−1), and m-th rows in order from the top in the drawing. In order to generally describe the scanning line 12 without specifying a column, a notation of "i-th row" may be used using an integer i of 1 to m.

Also, the data lines 14*b* are grouped every three columns in FIGS. 2 and 3. Here, in order to generally describe the group, when an integer j of 1 to q is used, a total of three columns of data lines 14*b* which are a (3j−2)-th column, a (3j−1)-th column, and a (3j)-th column belong to a j-th group counting from the left.

The three pixel circuits 110 corresponding to the intersections between the scanning line 12 in the same row and the data lines 14*b* in three columns belonging to the same group respectively correspond to R (red), G (green), and B (blue) pixels, and these three pixels represent one dot of a color image to be displayed. That is, in the embodiment, a color of one dot is represented with an additive color mixture by a total of three pixel circuits 110 corresponding to RGB.

The scanning line drive circuit 120 generates scanning signals for sequentially scanning the scanning lines 12 row by row, in accordance with the control signal Y_Ctr. Here, the scanning signals supplied to the scanning lines 12 in 1, 2, 3, . . . , (m−1), and m-th rows are respectively denoted by /Gwr(1), /Gwr(2), . . . , /Gwr(m−1), and /Gwr(m). The scanning signal supplied to the scanning line 12 in an i-th row is denoted by /Gwr(i).

The scanning line drive circuit 120, in addition to the scanning signals /Gwr(1) to /Gwr(m), generates control signals synchronized with the scanning signals row by row and supplies the signals to the display region 100, but such illustration is omitted in FIG. 3.

In the electro-optical device 10, a data transmission line 14*a* is provided corresponding to the data line 14*b*. The switch group 40 is a collection of transmission gates 45 provided for each of the data transmission lines 14*a*.

Among the transmission gates 45, input terminals of q transmission gates 45 corresponding to the data transmission lines 14*a* in the 1, 4, 7, . . . , (3q−2)-th columns are commonly coupled. The data signal Vd(1) is supplied to the input terminals in time series for each pixel.

Additionally, the input terminals of the q transmission gates 45 corresponding to the data transmission lines 14*a* in the 2, 5, 8, . . . , (3q−1)-th columns are commonly coupled, and the data signal Vd(2) is supplied to the input terminals in time series for each pixel.

Likewise, the input terminals of the q transmission gates 45 corresponding to the data transmission lines 14*a* in the 3, 6, 9, . . . , (3q)-th columns are commonly coupled, and the data signal Vd(3) is supplied to the input terminals in time series for each pixel.

An output terminal of the transmission gate 45 in a certain column is coupled to one end of the data transmission line 14*a* in the column.

Three transmission gates 45 corresponding to (3j−2), (3j−1), and (3j)-th columns belonging to the j-th group are in an ON state when the control signal Sel(j) is at the H level (when the control signal /Sel(j) is at the L level), and are in an OFF state when the control signal Sel(j) is at the L level (when the control signal /Sel(j) is at the H level).

In FIG. 3, only a first group and a q-th group are illustrated, and other groups are omitted due to the limited drawing space. Also, the transmission gate 45 of FIG. 3 is simplified and represented as a switch in FIG. 2.

In the description, "ON state" of the switch, transistor or transmission gate means that both ends of the switch, the source node and the drain node in the transistor, or the input terminal and the output terminal of the transmission gate are electrically coupled to form a low impedance state. Also, "OFF state" of the switch, transistor or transmission gate means that both ends of the switch, the source node and the drain node, or both ends of transmission gate are electrically non-coupled to form a high impedance state.

Also, "electrically coupled" or simply "coupled" in the description means a direct or indirect coupling or connection between two or more elements.

The capacitance element group 50 is a collection of capacitance elements 51 provided for each of the data transmission lines 14*a*. Here, one end of the capacitance element 41 corresponding to the data transmission line 14*a* in a certain column is coupled to one end of the data transmission line 14*a*, and the other end of the capacitance element 41 is grounded to a constant potential, for example, an electric potential that is a reference potential of zero voltage.

The initialization circuit 60 is a collection of P channel MOS type transistors 66, 67, and 68 provided for each of the data lines 14*b*. MOS is an abbreviation for "metal-oxide-semiconductor field-effect transistor".

A control signal /Drst is supplied to a gate node of a transistor 66 corresponding to the data lines 14*b* in a certain column, a voltage Vel is applied to a source node of the transistor 66, and a drain node of the transistor 66 is coupled to the data line 14*b* in the column. Also, a control signal /Gorst is supplied to a gate node of a transistor 67 corresponding to the data line 14*b* in a certain column, a reset voltage Vorst is applied via a feed line 118 to a source node of the transistor 67, and a drain node of the transistor 67 is coupled to the data line 14*b* in the column.

A control signal /Gini is supplied to a gate node of a transistor 68 corresponding to the data line 14*b* in a certain column, a voltage Vini is applied to a source node of the transistor 68, and a drain node of the transistor 68 is coupled to the data line 14*b* in the column.

The auxiliary circuit 70 is a collection of transmission gates 72 and 73 provided in each of the columns and capacitance elements 74 and 75 provided in each of the columns.

Here, when a control signal Gcp is at the H level (when a control signal /Gcp is at the L level), the transmission gate 72 corresponding to one column is in an ON state, and when the control signal Gcp is at the L level (when the control signal /Gcp is at the H level), the transmission gate 72 is in an OFF state.

An input terminal of the transmission gate 72 corresponding to one column is coupled to the other end of the data transmission line 14*a* in the column, and an output terminal of the transmission gate 72 corresponding to the column is coupled to an output terminal of the transmission gate 73 corresponding to the column, one end of the capacitance element 74 corresponding to the column, and one end of the capacitance element 75 corresponding to the column.

The transmission gate 73 corresponding to a certain column is in the ON state when a control signal Gref is at the H level (when the control signal /Gref is at the L level), and the transmission gate 73 is in the OFF state when the control signal Gref is at the L level (when the control signal /Gref is at the H level).

The voltage Vref is commonly applied to the input terminal of the transmission gate 73 in each of the columns.

Also, the other end of the capacitance element 75 corresponding to a certain column is grounded to a constant potential, for example, an electric potential that is a reference of zero voltage.

The other end of the capacitance element 74 corresponding to a certain column is coupled to one end of the data line 14*b* corresponding to the column.

In the first embodiment, one end of the data transmission line 14*a* is coupled to the output terminal of the transmission gate 45 and one end of the capacitance element 51, and the other end of the data transmission line 14*a* is coupled to the input terminal in the transmission gate 72. The display region 100 is located between the switch group 40 and the auxiliary circuit 70, and thus the data transmission line 14*a* passes through the display region 100.

On the other hand, the data signal supplied to the data transmission line 14*a* via the transmission gate 45 is supplied to the pixel circuit 110 as a data signal via the transmission gate 72, the capacitance element 74 and the data line 14*b*.

Thus, the data signal output from the data signal output circuit 30 reaches the auxiliary circuit 70 located at an opposite position with the display region 100 interposed therebetween via the data transmission line 14*a*, is turned back, and is supplied to the pixel circuit 110 via the data line 14*b* and the capacitance element 74.

In such a configuration, a region in which the capacitance element 74 is provided and the data signal output circuit 30 is located with the display region 100 interposed therebetween. Therefore, when the display region 100 is used as a reference, the elements are not concentrated in a region in which the data signal output circuit 30 is provided. The display region 100 needs to be separated to some extent from four sides, and a distance from the side is required to some extent even in a region in which the data signal output circuit 30 is not provided. When the elements are concentrated in a region of the data signal output circuit 30 and a periphery thereof, an area required in the region can be enlarged, and it can be a factor that hinders miniaturization. In contrast, in the configuration of the first embodiment, the area required in the region is reduced, and thus miniaturization can be achieved.

Figure 4:
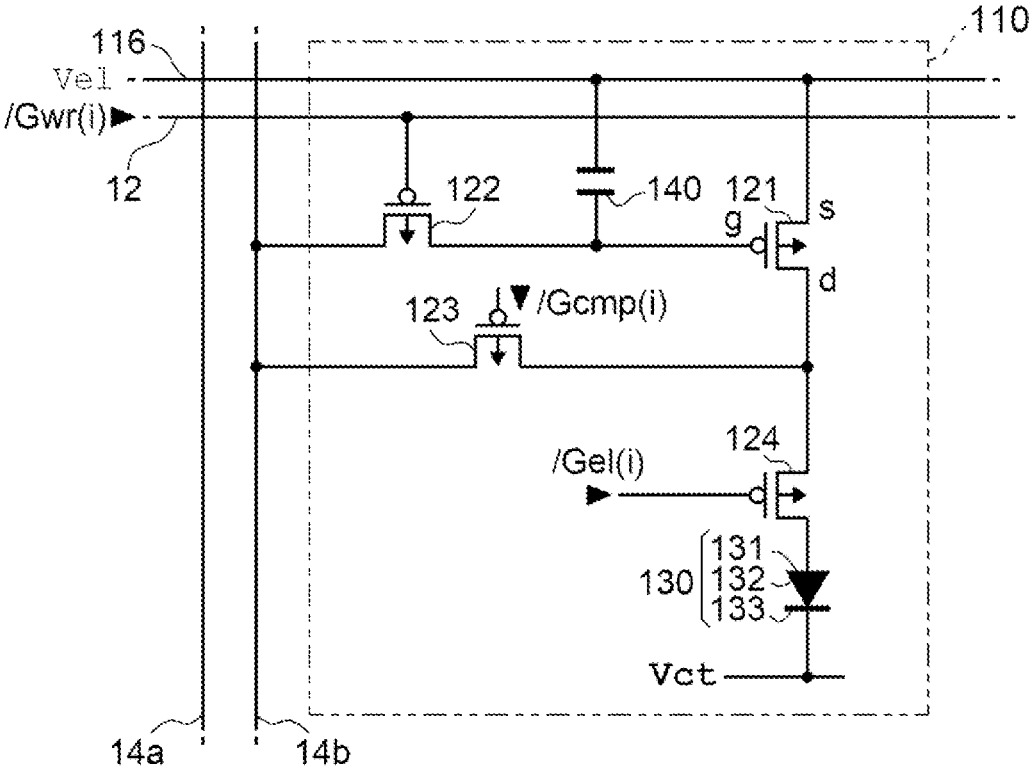
FIG. 4 is a diagram illustrating a pixel circuit in the electro-optical device.

FIG. 4 is a diagram illustrating a configuration of the pixel circuit 110. The pixel circuits 110 arranged in m rows and (3q) columns are electrically identical to each other. Thus, one pixel circuit 110 which is the i-th row and corresponds to any one column will be described as a representative of the pixel circuits 110.

As illustrated in the drawing, the pixel circuit 110 includes P-channel MOS type transistors 121 to 124, an OLED 130, and a capacitance element 140.

Further, in addition to the scanning signal /Gwr(i), the control signals /Gcmp(i) and /Gel(i) are supplied from the scanning line drive circuit 120 to the pixel circuit 110 in the i-th row.

The OLED 130 is a light emitting element in which a light emitting layer 132 is sandwiched between a pixel electrode 131 and a common electrode 133. The pixel electrode 131 functions as an anode, and the common electrode 133 functions as a cathode. The common electrode 133 has light reflectivity and light transmission. When a current flows from the anode to the cathode of the OLED 130, holes injected from the anode and electrons injected from the cathode are recombined in the light emitting layer 132 to generate excitons and generate white light.

In the embodiment, the generated white light resonates in an optical resonator configured of, for example, a reflective layer and a semi-reflective and semi-transparent layer which are not illustrated, and is emitted at a resonance wavelength set corresponding to any color of R (red), G (green), and B (blue). A color filter corresponding to the color is provided on the emission side of light from the optical resonator. Thus, the light emitted from the OLED 130 is visually recognized by an observer through coloration by the optical resonator and the color filter. The optical resonator is not illustrated. Further, when the electro-optical device 10 displays a monochromatic image having only light and darkness, the color filter is omitted.

In the transistor 121, a gate node g is coupled to a drain node of the transistor 122, a source node s is coupled to a feed line 116 of the voltage Vel, and a drain node d is coupled to a source node of the transistor 123 and a source node of the transistor 124. In the capacitance element 140, one end is coupled to the gate node g of the transistor 121, and the other end is coupled to a constant voltage, for example, the feed line 116 of the voltage Vel. Thus, the capacitance element 140 holds a voltage of the gate node g in the transistor 121.

Here, as the capacitance element 140, for example, a capacitance which is parasitic to the gate node g of the transistor 121 may be used, and a capacitance formed by interposing an insulating layer with mutually different conductive layers in a silicon substrate may be used.

In the transistor 122 of the pixel circuit 110 in the i-th row and in any one column, the gate node is coupled to the scanning line 12 in the i-th row, and the source node is coupled to the data line 14*b* in the column.

In the transistor 123 of the pixel circuit 110 in the i-th row and in any one column, the control signal /Gcmp(i) is supplied to the gate node, and the drain node is coupled to the data line 14*b* in the column.

In the transistor 124 of the pixel circuit 110 in the i-th row and in any one column, the control signal /Gel(i) is supplied to the gate node, and the drain node is coupled to the pixel electrode 131 which is the anode of the OLED 130, and the drain node of the transistor 125.

The common electrode 133 that functions as the cathode of the OLED 130 is coupled to a feed line of a voltage Vct. Further, since the electro-optical device 10 is formed on a silicon substrate, a substrate potential of each of the transistors 121 to 124 is, for example, a potential corresponding to a voltage Vel.

Figure 5:
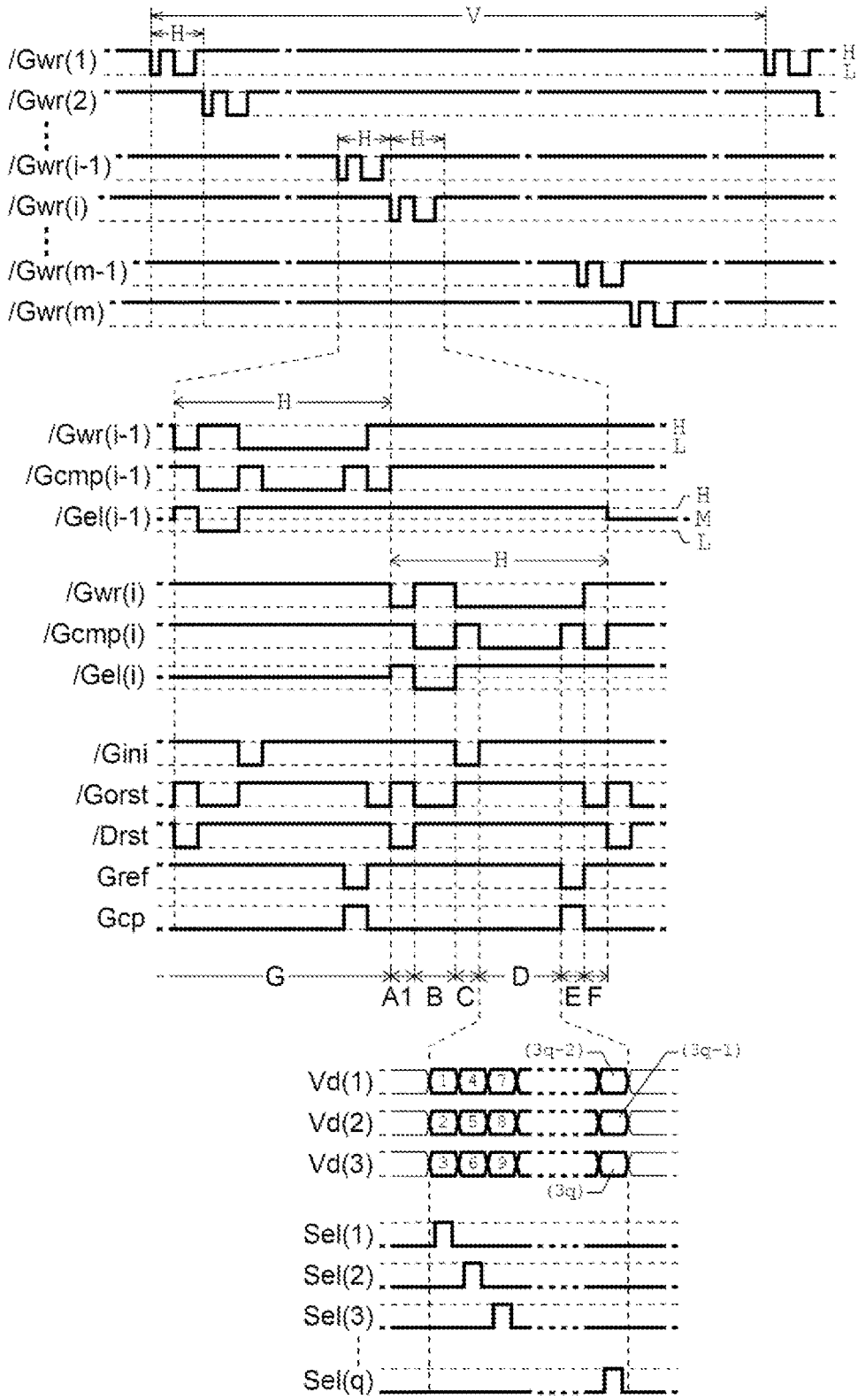
FIG. 5 is a timing chart illustrating an operation of the electro-optical device.
Figure 6:
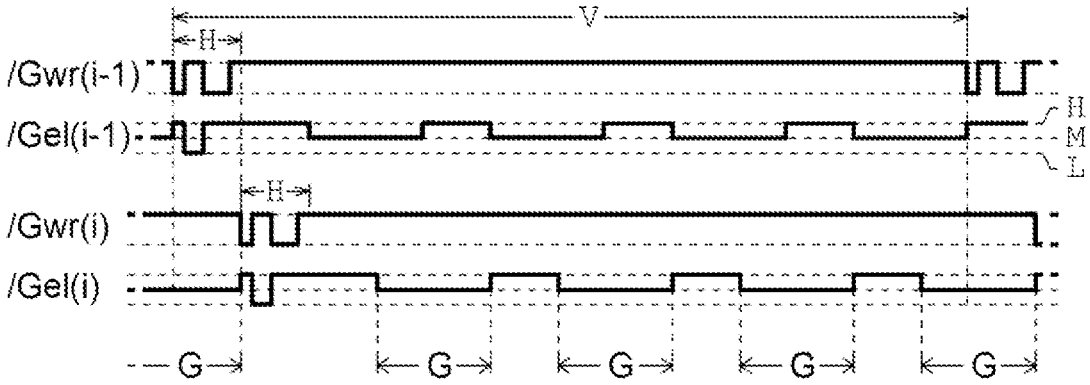
FIG. 6 is a timing chart illustrating the operation of the electro-optical device.

FIGS. 5 and 6 are timing charts for describing an operation of the electro-optical device 10.

In the electro-optical device 10, horizontal scanning is performed in the order of 1, 2, 3, . . . , m-th rows in a period of one frame (V).

In the description, the period of one frame (V) is a period required to display one frame of an image specified by the video data Vid. When a length of the period of one frame is the same as a vertical synchronization period, for example, when a frequency of a vertical synchronization signal included in the synchronization signal Sync is 60 Hz, the length of the period is 16.7 milliseconds corresponding to one cycle of the vertical synchronization signal. Also, a period required for horizontal scanning for one row is a horizontal scanning period (H). In addition, in FIGS. 5 and 6, a vertical scale indicating a voltage is not always provided over each of the signals.

An operation in a horizontal scanning period (H) in each row is mostly common in the pixel circuit 110. Also, an operation of the pixel circuit 110 in the first to (3q)-th columns of the row scanned in a certain horizontal scanning period (H) is mostly common. Therefore, the following description will focus on the pixel circuit 110 in the (3j−2) column and in the i-th row.

In the electro-optical device 10, the horizontal scanning period (H) is divided into six periods of initialization periods (A1), (B), and (C), a compensation period (D), a writing period (E), and a discharge period (F) in order of time. Further, as the operation of the pixel circuit 110, a light emission period (G) is further added to the six periods described above.

Among the initialization periods (A1), (B), and (C), the initialization period (A1) is a period for setting the transistor 121 to the OFF state and is a period for advance preparation processing of the initialization period (C). The initialization period (B) is a process for resetting the potential at the anode of the OLED 130, and the initialization period (C) is a period for applying a voltage to cause the transistor 121 to be in the ON state to the gate node g at the beginning of the compensation period (D).

In the initialization period (A1) of each of the horizontal scanning periods (H), the control signals /Gini and/Gorst are at the H level, the control signal /Drst is at the L level, the control signal Gref is at the H level, and the control signal Gcp is at the L level. Thus, the transistor 68 is in the OFF state, the transistor 67 is in the OFF state, the transistor 66 is in the ON state, the transmission gate 73 is in the ON state, and the transmission gate 72 is in the OFF state.

Further, in the initialization period (A1) of the horizontal scanning period (H) in which the i-th row is selected, the scanning signal /Gwr(i) is at the L level, the control signal /Gcmp(i) is at the H level, and the control signal /Gel(i) is at the H level. Therefore, in the pixel circuit 110, the transistor 122 is in the ON state, and the transistors 123 and 124 are in the OFF state.

Figure 7:
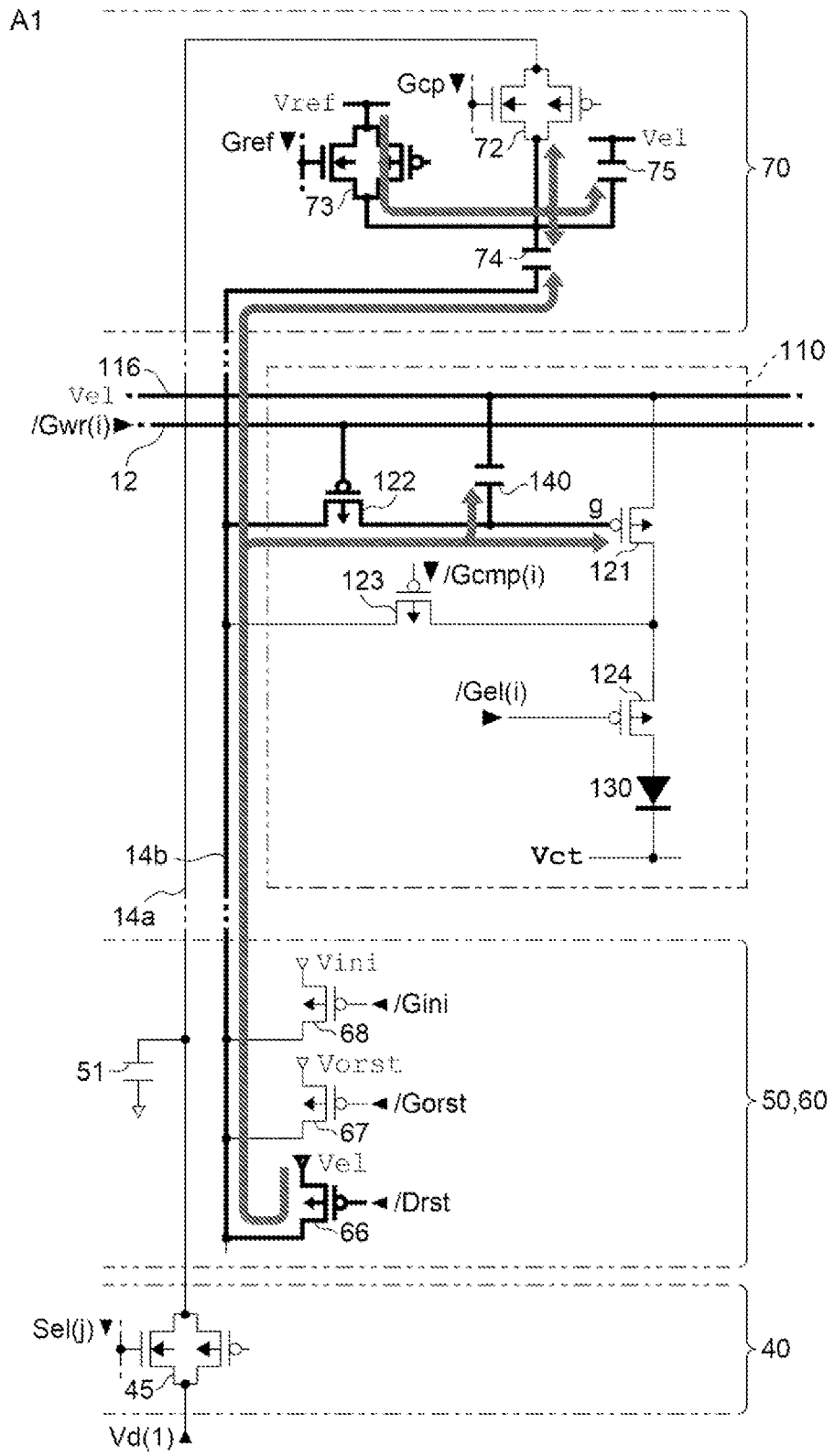
FIG. 7 is a diagram for describing the operation of the electro-optical device.

Thus, in the initialization period (A1), as illustrated in FIG. 7, a voltage Vref is applied via the transmission gate 73 to one end of the capacitance element 74, one end of the capacitance element 75 and the output terminal of the transmission gate 72. Additionally, in the pixel circuit 110, the voltage Vel is applied to one end of the capacitance element 140 and the gate node g of the transistor 121 via the transistor 66, the data line 14*b*, and the transistor 122 in order. When the voltage Vel is applied to the gate node g, since the voltage between the gate node and the source node becomes zero, the transistor 121 is forcibly turned to the OFF state, and a current flowing through the OLED 130 is cut off. Furthermore, since the voltage Vel is applied to the other end of the capacitance element 74 via the data line 14*b*, the capacitance element 74 is charged to a voltage |Vel−Vref|.

In FIG. 7, a bold line indicates a path for applying a voltage, and does not necessarily indicate a direction in which a current flows. The same applies to FIGS. 8 to 12 and 17 to 20.

In the initialization period (B) of each of the horizontal scanning periods (H), the control signal /Gini is at the H level, the control signal /Gorst reaches the L level, the control signal /Drst reaches the H level, and the control signal Gref reaches the H level, and the control signal Gcp is at the L level. Thus, the transistor 68 maintains the OFF state, the transistor 67 changes to the ON state, the transistor 66 changes to the OFF state, the transmission gate 73 maintains the ON state, and the transmission gate 72 maintains the OFF state.

In addition, in the initialization period (B) of the horizontal scanning period (H) in which the i-th row is selected, the scanning signal /Gwr(i) reaches the H level, the control signal /Gcmp(i) reaches the L level, and the control signal /Gel(i) reaches the L level. Thus, the transistor 122 in the pixel circuit 110 changes to the OFF state, and the transistors 123 and 124 change to the ON state.

Figure 8:
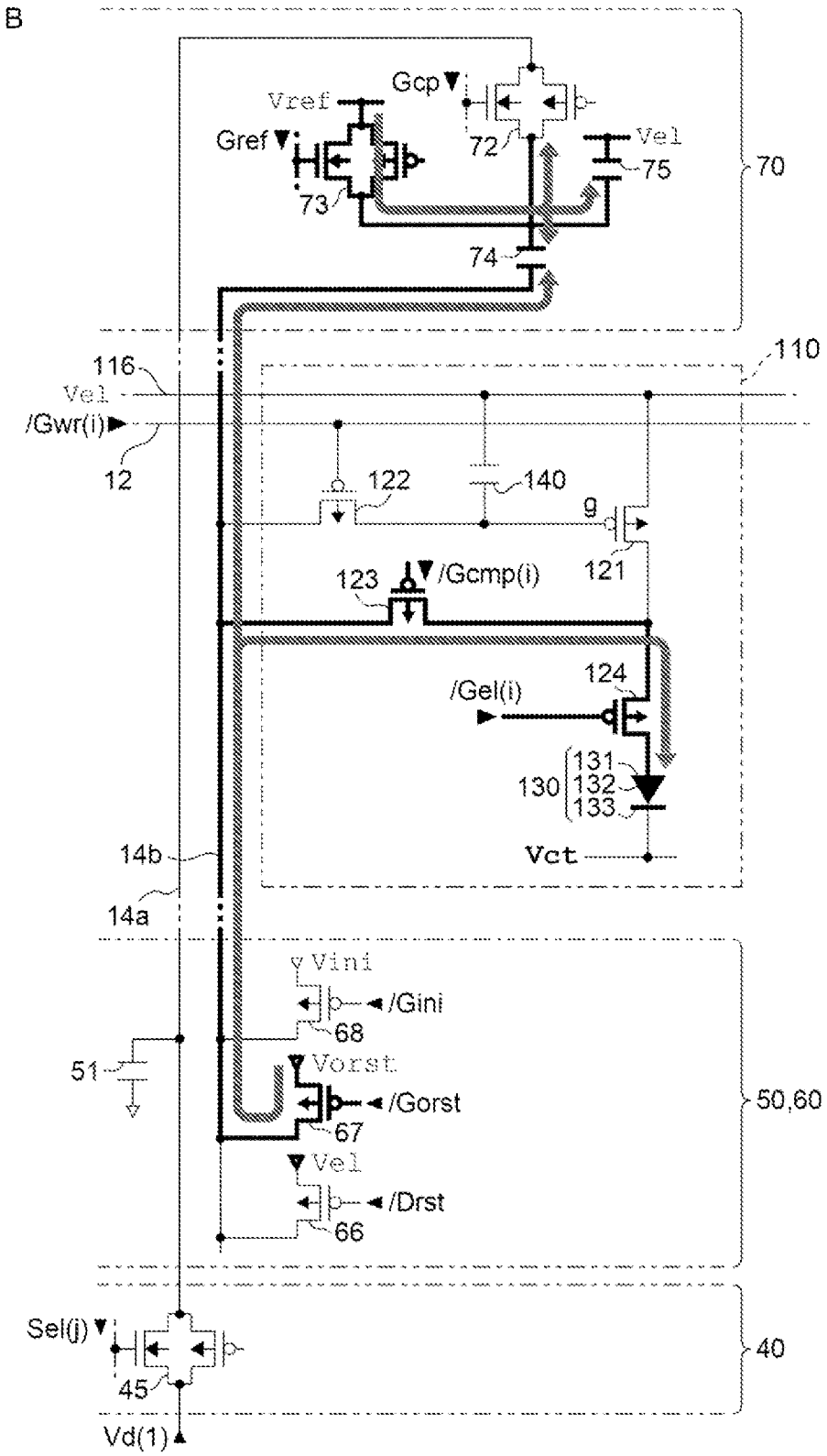
FIG. 8 is a diagram for describing the operation of the electro-optical device.

Thus, in the initialization period (B), as illustrated in FIG. 8, one end of the capacitance element 74, one end of the capacitance element 75, and the output terminal of the transmission gate 72 are maintained at the voltage Vref. Additionally, in the pixel circuit 110, a reset voltage Vorst is applied to the pixel electrode 131, which is the anode of the OLED 130, via the transistor 67, the data line 14*b*, the transistor 123, and 124 in order. Since the OLED 130 sandwiches the light emitting layer 132 between the pixel electrode 131 and the common electrode 133, a capacitance component is parasitic. In the initialization period (B), a voltage held in the capacitance component, specifically, a voltage corresponding to a current flowing through the OLED 130 in the light emission period (G) is reset by the application of the reset voltage Vorst to the pixel electrode 131. The reset voltage Vorst is a voltage that causes the OLED 130 not to emit light, and specifically, is a zero volts corresponding to the L level, or a voltage (0 to 1 Volts) close to the zero volts. Furthermore, since the reset voltage Vorst is applied to the other end of the capacitance element 74 via the data line 14*b*, the capacitance element 74 is charged to a voltage |Vorst−Vref|.

In the initialization period (C) of each of the horizontal scanning periods (H), the control signal /Gini reaches the L level, the control signal /Gorst reaches the H level, the control signal /Drst is at the H level, the control signal Gref is at the H level, and the control signal Gcp is at the L level. Thus, the transistor 68 changes to the ON state, the transistor 67 changes to the OFF state, the transistor 66 maintains the OFF state, the transmission gate 73 maintains the ON state, and the transmission gate 72 maintains the OFF state.

In addition, in the initialization period (C) of the horizontal scanning period (H) in which the i-th row is selected, the scanning signal /Gwr(i) reaches the L level, the control signal /Gcmp(i) reaches the H level, and the control signal /Gel(i) reaches the H level. Therefore, in the pixel circuit 110, the transistor 122 changes to the ON state, and the transistors 123 and 124 change to the OFF state.

Figure 9:
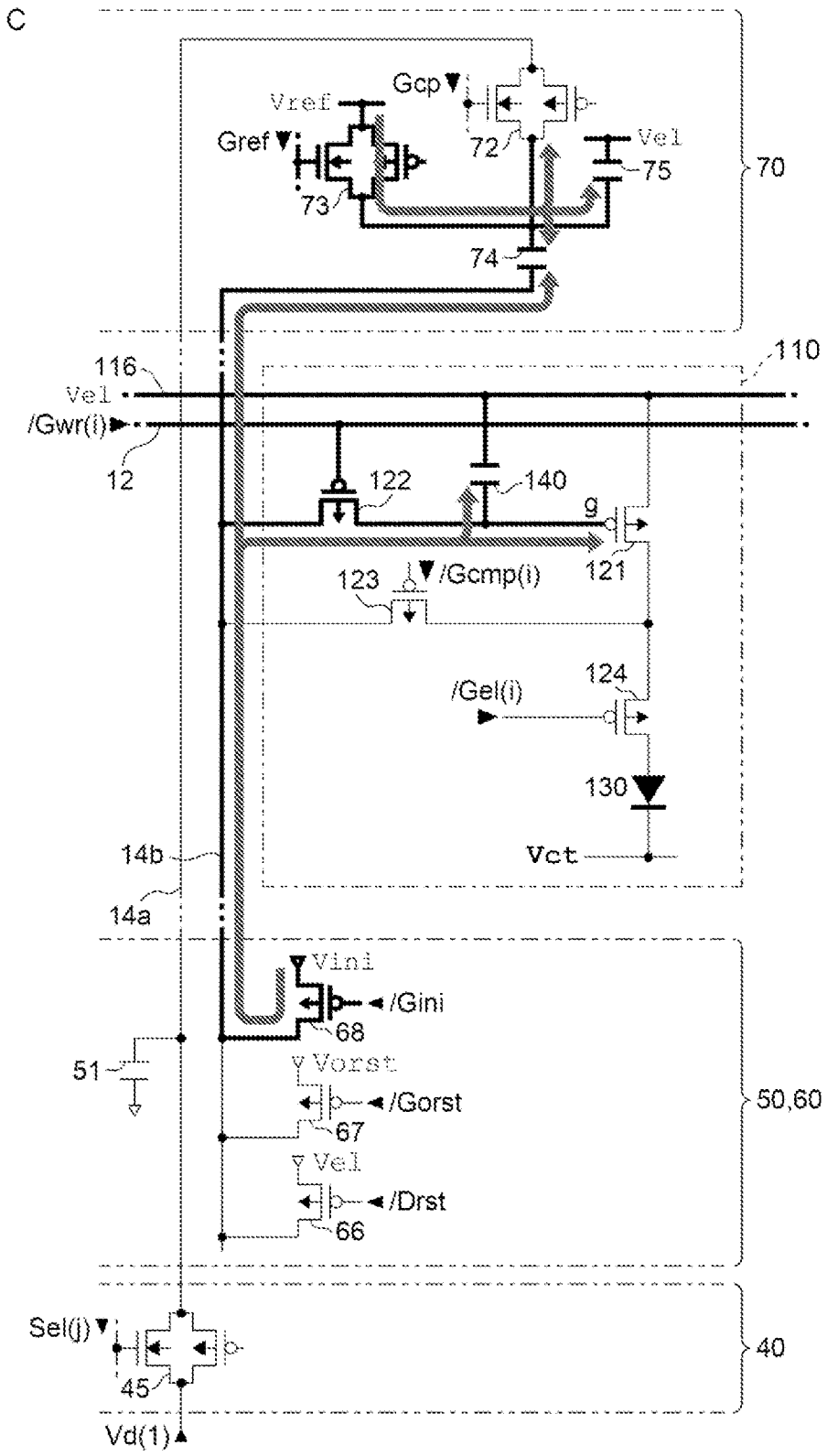
FIG. 9 is a diagram for describing the operation of the electro-optical device.

Thus, in the initialization period (C), as illustrated in FIG. 9, one end of the capacitance element 74, one end of the capacitance element 75, and the output terminal of the transmission gate 72 are maintained at the voltage Vref. Additionally, in the pixel circuit 110, the voltage Vini is applied to one end of the capacitance element 140 and the gate node g of the transistor 121 via the transistor 68, the data line 14*b*, and the transistor 122 in order. Since the voltage Vini is applied to the other end of the capacitance element 74 via the data line 14*b*, the capacitance element 74 is charged to a voltage |Vini−Vref|.

In the compensation period (D) of each of the horizontal scanning periods (H), the control signal /Gini is at the H level, the control signal /Gorst is at the H level, the control signal /Drst is at the H level, the control signal Gref is at the H level, and the control signal Gcp is at the L level. Thus, the transistor 68 changes to the OFF state, the transistor 67 maintains the OFF state, the transistor 66 maintains the OFF state, the transmission gate 73 maintains the ON state, and the transmission gate 72 maintains the OFF state.

Additionally, in the compensation period (D) of the horizontal scanning period (H) in which the i-th row is selected, the scanning signal /Gwr(i) is at the L level, the control signal /Gcmp(i) changes to the L level, and the control signal /Gel (i) is at the H level. Therefore, in the pixel circuit 110, the transistor 122 maintains the ON state, the transistor 123 changes to the ON state, and the transistor 124 maintains the OFF state.

Figure 10:
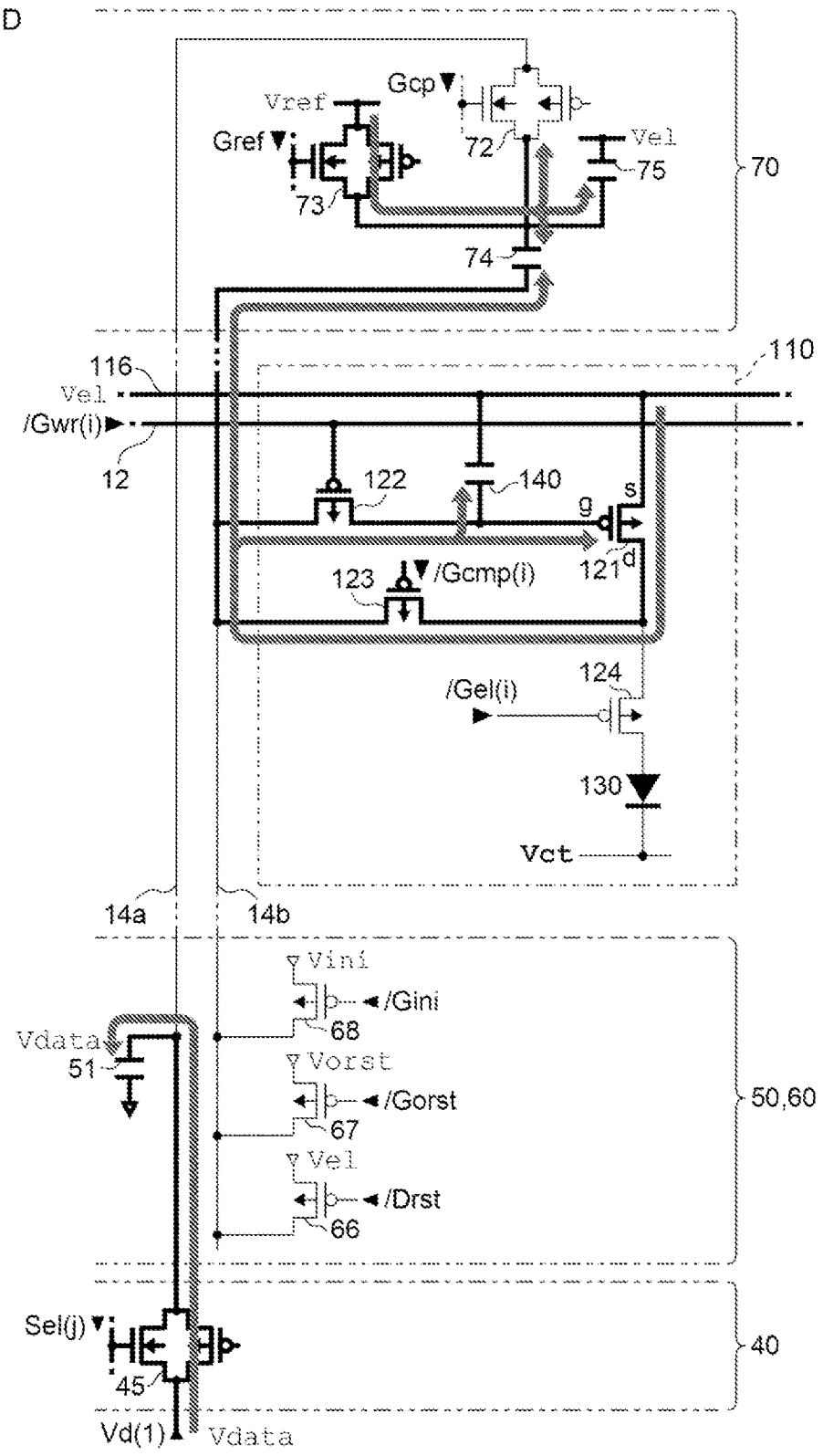
FIG. 10 is a diagram for describing the operation of the electro-optical device.

Thus, in the compensation period (D), as illustrated in FIG. 10, one end of the capacitance element 74, one end of the capacitance element 75, and the output terminal of the transmission gate 72 are maintained at the voltage Vref.

In the pixel circuit 110, the capacitance element 140 in a state of holding a voltage (Vel−Vini) as a voltage between the gate node and the source node of the transistor 121 in the immediately preceding initialization period (C).

In this state, when the transistors 122 and 123 are turned into the ON state, the transistor 121 is turned into the ON state, and the transistor 121 is in a state in which the gate node and the drain node are coupled, that is, in a diode coupling state. Therefore, a voltage Vgs between the gate node and the source node in the transistor 121 converges to a threshold voltage of the transistor 121. Here, when the threshold voltage is expressed as Vth for convenience, the gate node g of the transistor 121 converges to a voltage (Vel−Vth) corresponding to the threshold voltage Vth.

At the beginning of the compensation period (D), it is necessary that a current flows from the source node to the drain node in the transistor 121 coupled to a diode. Thus, the voltage Vini applied to the gate node g in the initialization period (C) before the compensation period (D) has a relationship of Vini<Vel−Vth.

Further, in the compensation period (D), the gate node g of the transistor 121 is coupled to the data line 14*b* via the transistor 122, and the drain node of the transistor 121 is coupled to the data line 14*b* via the transistor 123. Therefore, the other ends of the data line 14*b* and the capacitance element 74 also converge to the voltage (Vel−Vth). Therefore, the capacitance element 74 is charged to a voltage |Vel−Vth−Vref|.

In the compensation period (D), the control signals Sel(1) to Sel(q) sequentially and exclusively reach the H level. Although omitted in FIG. 10, in the compensation period (D), the control signals /Sel(1) to /Sel(q) sequentially and exclusively reach the L level in synchronization with the control signals Sel(1) to Sel(q). Furthermore, the data signal output circuit 30 outputs three-pixel data signals Vd(1) to Vd(3) corresponding to the intersection between the scanning line 12 in the i-th row and the data lines 14*b* belonging to a j-th group, for example, when the control signal Sel(j) among the control signals Sel(1) to Sel(q) reaches the H level. More specifically, the data signal output circuit 30 outputs a data signal Vd(1) corresponding to a pixel in the i-th row and the (3j−2)-th column in a period in which the control signal Sel(j) reaches the H level, outputs a data signal Vd(2) corresponding to a pixel in the i-th row and the (3j−1)-th column, and outputs a data signal Vd(3) corresponding to a pixel in the i-th row and the (3j)-th column.

As a specific example, when j is "2", the data signal output circuit 30 outputs the data signal Vd (1) corresponding to the pixel in the i-th row and the fourth column in a period in which the control signal Sel(2) reaches the H level, outputs the data signal Vd(2) corresponding to the pixel in the i-th row and the fifth column, and outputs the data signal Vd(3) corresponding to the pixel in the i-th row and the sixth column.

When the control signals Sel(1) to Sel(q) sequentially and exclusively reach the H level, a voltage of the data signal corresponding to each pixel is held in the capacitance element 51 corresponding to the first column to the (3q)-th column.

FIG. 10 illustrates a state in which the control signal Sel(j) corresponding to the j-th group to which the pixel circuit 110 belongs reaches the H level in the compensation period (D) and the voltage Vdat of the data signal Vd(1) is held in the capacitance element 51.

In the writing period (E) in each of the horizontal scanning periods (H), the control signal /Gini is at the H level, the control signal /Gorst is at the H level, the control signal /Drst is at the H level, and the control signal Gref is at the L level, and the control signal Gcp is at the H level. Thus, the transistors 68, 67, and 66 maintain the OFF state, the transmission gate 73 changes to the OFF state, and the transmission gate 72 changes to the ON state.

Further, in the writing period (E) of the horizontal scanning period (H) in which the i-th row is selected, the scanning signal /Gwr(i) is at the L level, the control signal /Gcmp(i) changes to the H level, and the control signal /Gel(i) is at the H level. Thus, in the pixel circuit 110, the transistor 122 maintains the ON state, the transistor 123 changes to the OFF state, and the transistor 124 maintains the OFF state.

Figure 11:
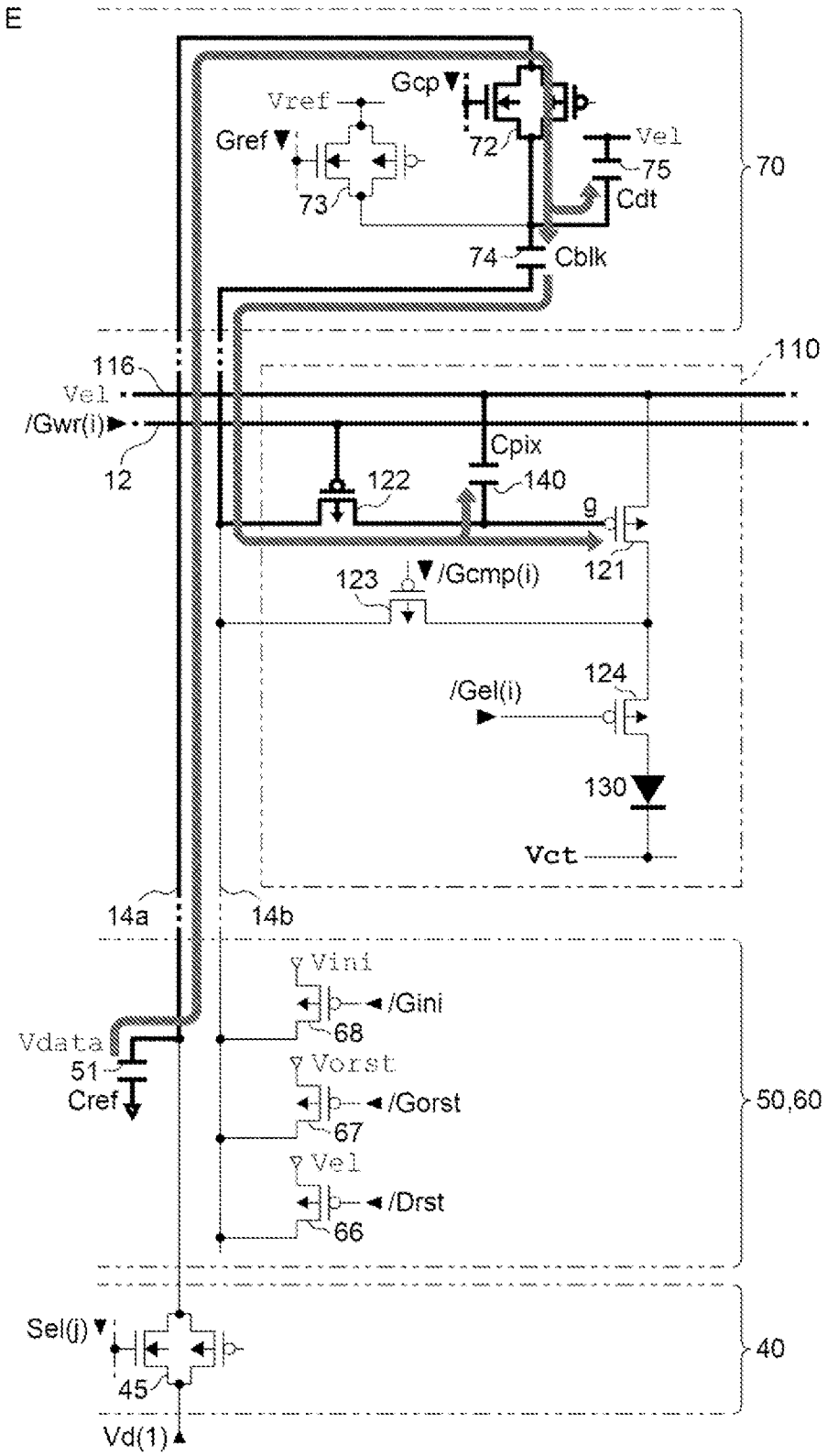
FIG. 11 is a diagram for describing the operation of the electro-optical device.

Thus, in the writing period (E) of the horizontal scanning period (H) in which the i-th row is selected, as illustrated in FIG. 11, due to the OFF state of the transmission gate 73 and the ON state of the transmission gate 72, one end of the capacitance element 74 changes from the voltage Vref in accordance with the voltage held at one end of the capacitance element 51. The voltage change is propagated to the gate node g via the capacitance element 74, the data line 14*b*, and the transistor 122 in order. The voltage of the gate node g after the change is held in the capacitance element 140.

As illustrated in FIG. 11, the capacitance of the capacitance element 51 is denoted by Cref, the capacitance of the capacitance element 74 is denoted by Cblk, the capacitance of the capacitance element 75 is denoted by Cdt, and the capacitance of the capacitance element 140 is denoted by Cpix. Additionally, in the compensation period (D), the voltage of the data signal Vd(1) held at one end of the capacitance element 51 is denoted by Vdat.

The voltage change ΔV of the gate node g from the compensation period (D) to the writing period (E) is indicated by Equation (1) below.

[Equation 1]

$$\Delta V = \frac{\frac{Cblk(Cdt+Cpix)}{Cblk+Cdt+Cpix} \times Vref + Cref \times Vdata}{\frac{Cblk(Cdt+Cpix)}{Cblk+Cdt+Cpix} \times (Vdata - Vref)} - Vref = \frac{Cref}{\frac{Cblk(Cdt+Cpix)}{Cblk+Cdt+Cpix}} \times (Vdata - Vref) = Ka \times (Vdata - Vref) \quad (1)$$

That is, as illustrated in Equation (1), the gate node g changes to a value obtained by multiplying a voltage change (Vdat−Vref) at one end of the capacitance element 74 by a coefficient Ka. The coefficient Ka is a coefficient of less than "1", and is determined by the capacitances Cref, cblk, cdt, and Cpix. In other words, each of the capacitances Cref, Cblk, cdt and Cpix is designed to have an appropriate value, and the coefficient Ka is less than "1". When the coefficient Ka is less than "1", a voltage amplitude from the lowest value to the maximum value of the voltage Vdat of the data signal is compressed in accordance with the coefficient Ka and is propagated to the gate node g.

When the pixel circuit 110 is miniaturized, the current flowing through the OLED 130 may change significantly with respect to a very slight change in a voltage Vgs between the gate node and the source node of the transistor 121.

Also in this case, in the first embodiment, since the voltage amplitude of the voltage Vdat of the data signal is compressed in accordance with the coefficient Ka and is propagated to the gate node g, the current flowing in the OLED 130 can be controlled accurately.

After the writing period (E), the discharge period (F) is reached. In the discharge period (F), the control signal /Gini is at the H level, the control signal /Gorst reaches the L level, the control signal /Dst is at the H level, the control signal Gref reaches the H level, and the control signal Gcp reaches the L level. Thus, the transistors 68 and 66 maintain the OFF state, the transistor 67 changes to the ON state, the transmission gate 73 maintains the OFF state, and the transmission gate 72 changes to the OFF state.

In addition, in the discharge period (F) of the horizontal scanning period (H) in which the i-th row is selected, the scanning signal /Gwr(i) reaches the H level, the control signal /Gcmp(i) reaches the L level, and the control signal /Gel(i) is at the H level.

Thus, in the pixel circuit 110, the transistor 122 changes to the OFF state, the transistor 123 changes to the ON state, and the transistor 124 maintains the OFF state.

Figure 12:
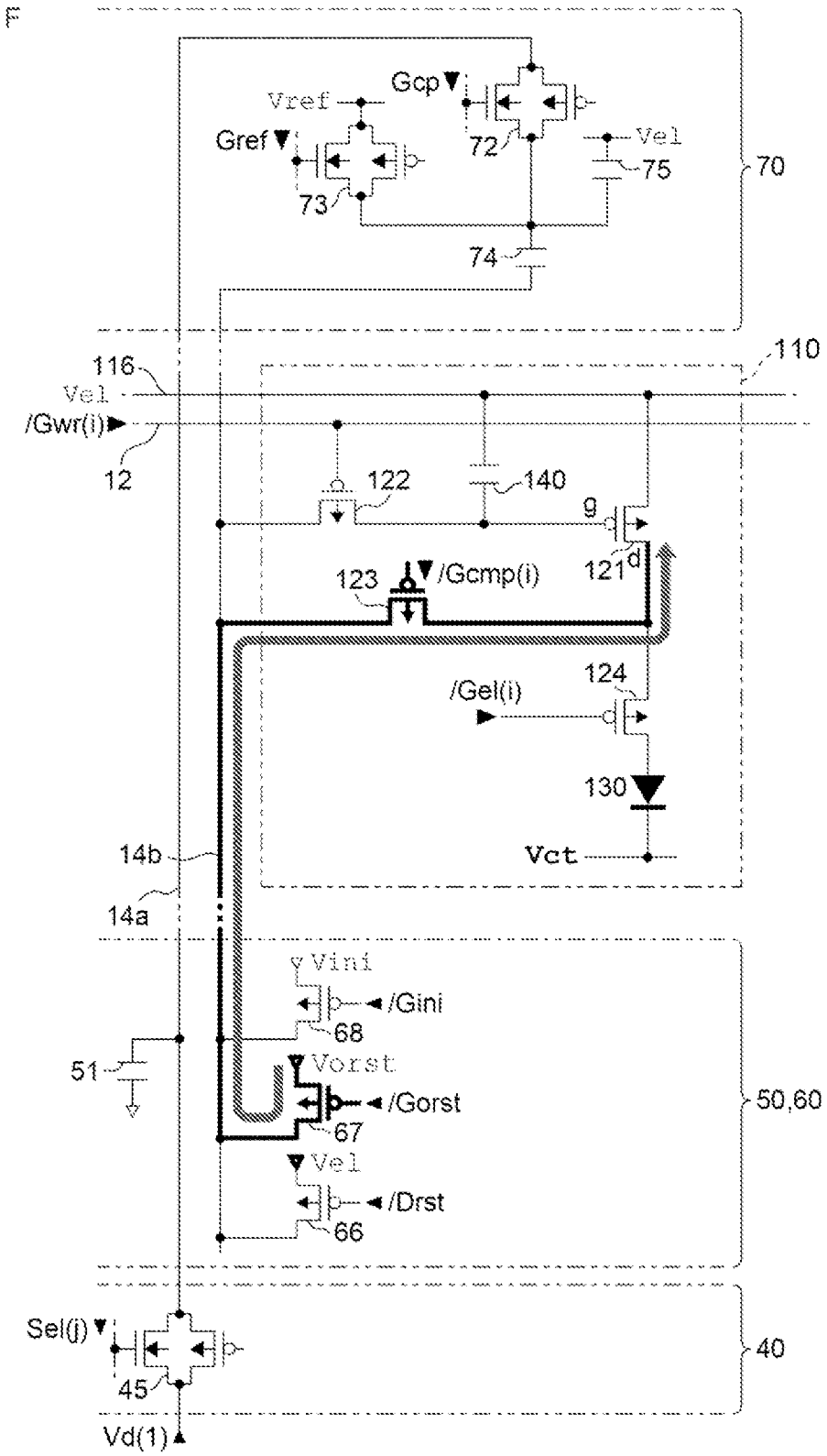
FIG. 12 is a diagram for describing the operation of the electro-optical device.

Thus, in the discharge period (F) of the horizontal scanning period (H) in which the i-th row is selected, as illustrated in FIG. 12, the reset voltage Vorst is applied to the drain node d of the transistor 121 via the transistor 67 in the ON state, the data line 14*b*, and the transistor 123 in the ON state in order. In other words, the reset voltage Vorst is applied to the drain node d of the transistor 121.

After the end of the discharge period (F), the light emission period (G) is reached. In the first embodiment, the discharge period (F) in the i-th row occurs, for example, four times as shown in FIG. 6 from the horizontal scanning period (H) in which the i-th row is selected to the horizontal scanning period (H) in which the i-th row is selected again after a period of one frame (V) has elapsed. Specifically, after the horizontal scanning period (H) in which the i-th row is selected, the light emission period (G) in which the control signal /Gel(i) reaches an M level occurs four times at approximately the same interval, and a temporal length of the period at which the M level is reached is also set to be approximately the same length.

Figure 13:
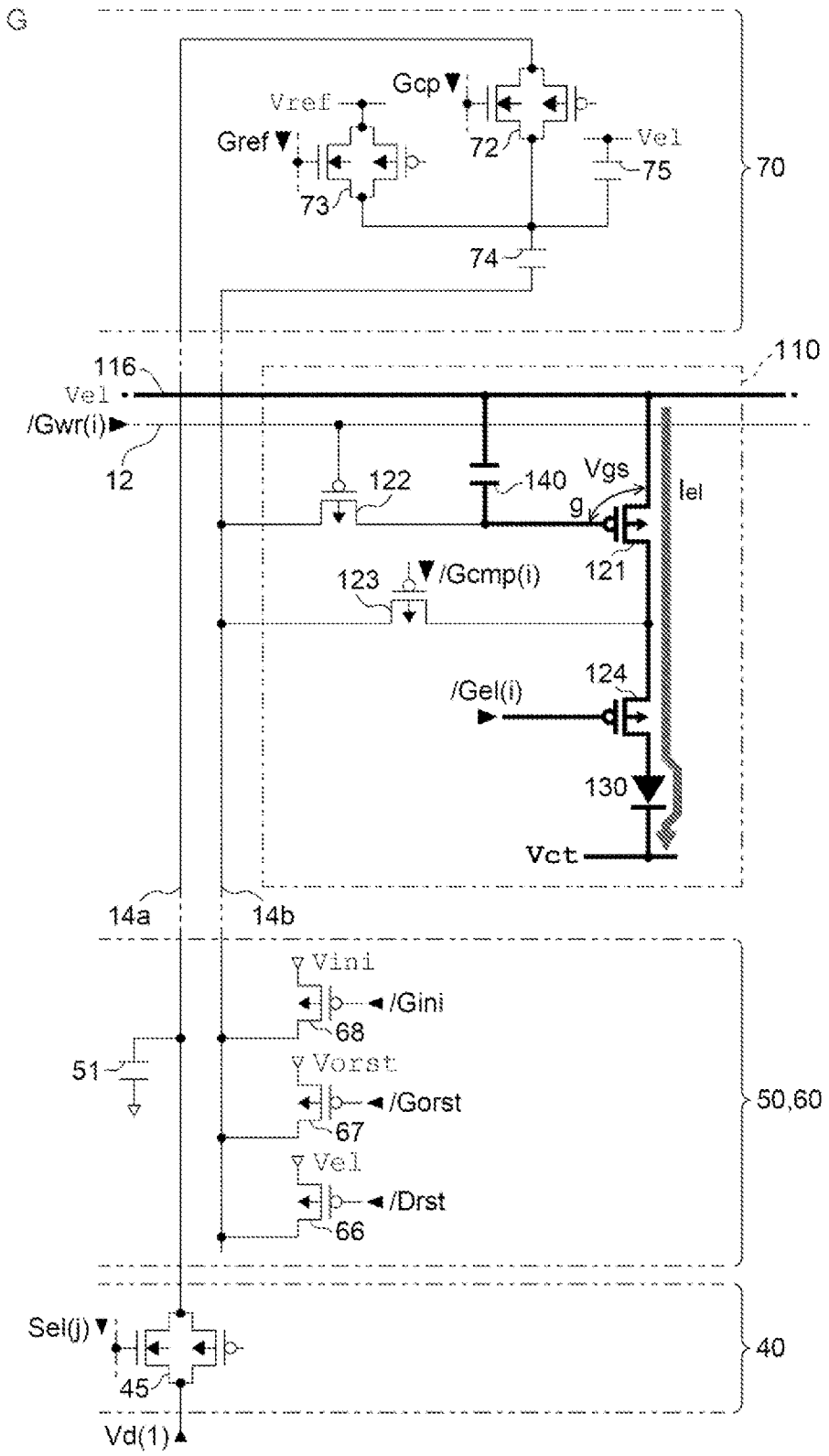
FIG. 13 is a diagram for describing the operation of the electro-optical device.

In the light emission period (G), when the control signal /Gel(i) reaches the M level, as illustrated in FIG. 13, the transistor 121 is a current Iel in accordance with the voltage Vgs, and the current Iel limited by resistance between a source and a drain of the transistor 124 flows through the OLED 130. Therefore, the OLED 130 emits light at luminance in accordance with the current Iel.

In FIGS. 7 to 13, a region in which the capacitance element group 50 and the initialization circuit 60 are provided is not particularly distinguished.

In the first embodiment, the amplitude of the voltage Vdat of the data signal output from the data signal output circuit 30 is compressed by passing through the capacitance element 74 and is supplied to the gate node g in the pixel circuit 110 as a data signal.

On the other hand, in the first embodiment, in the compensation period (D), a threshold voltage Vth of the transistor 121 is compensated for.

Therefore, next, the usefulness of the compensation period (D) will be described. In describing the usefulness, to avoid complicating Equation, it is assumed that a compression ratio of the voltage Vdat of the data signal is "1", that is, the voltage Vdat of the data signal is supplied to the data line 14*b* as it is in the writing period (E) after the compensation period (D). Furthermore, in the light emission period (G), it is assumed that the L level is applied to the gate node of the transistor 124 instead of the M level, the transistor 124 is turned on, and the resistance between the source node and the drain node is ideally zero.

First, the current Iel flowing through the OLED 130 in the light emission period (G) can be expressed as Equation (2) below.

[Equation 2]

$$Iel = k_1(Vgs - Vth)^2 \quad (2)$$

A coefficient k1 in Equation 2 is represented by the following Equation 3.

[Equation 3]

$$k_1 = (W/2L) - \mu Cox \quad (3)$$

In Equation 3, W is a channel width of the transistor 121, L is a channel length of the transistor 121, μ is mobility of a carrier, and Cox is a capacitance per unit area of a (gate) oxide film in the transistor 121.

In a configuration in which the voltage Vdat of the data signal is not compressed and a threshold voltage of the transistor 121 is not compensated for, when the voltage Vdat of the data signal is directly applied to the gate node g of the transistor 121, the voltage Vgs between the gate node and the source node of the transistor 121 can be expressed by the following Equation 4.

[Equation 4]

$$Vgs = |Vel - Vdat| \quad (4)$$

At this time, the current Iel flowing through the OLED 130 can be expressed as the following Equation 5.

[Equation 5]

$$Iel=k_1(Vgs-Vh)^2$$

$$=k_1(Vel-V\text{data}-Vth)^2 \quad (5)$$

As represented in Equation (5), the current Iel is influenced by the threshold voltage Vth. Here, in regard to the semiconductor process, a deviation of the threshold voltage Vth in the transistor 121 is in a range of several mV to several tens of mV. When the threshold voltage Vth of the transistor 121 is varied in the range of several mV to several tens of mV, the current Iel may generate a difference of at most 40% between the adjacent pixel circuits 110.

Current-luminance characteristics in the OLED 130 are generally linear. Therefore, in a configuration in which the threshold voltage Vth is not compensated for, even when the data signal having the same voltage Vdat is supplied to two pixel circuits 110 to make two OLEDs 130 emit light with the same luminance, the currents flowing through the OLEDs 130 are actually different. Therefore, in the configuration in which the threshold voltage Vth is not compensated for, the luminance is varied, and display quality will be significantly impaired.

In the compensation period (D), when the gate node g in the transistor 121 is converged to the voltage (Vel–Vth) and then changed to the voltage Vdat, the voltage Vgs between the gate node and the source node of the transistor 121 can be expressed by the following Equation 6.

[Equation 6]

$$Vgs=Vth-k_2(V\text{data}-V\text{ref}) \quad (6)$$

A coefficient $k_2$ in Equation 6 is a coefficient determined by the capacitances Cblk and Cpix in the configuration in which the voltage Vdat of the data signal is not compressed (a configuration without the capacitance element 74).

When the voltage Vgs is represented as in Equation 6, the current Iel flowing through the OLED 130 can be expressed as the following Equation 7.

[Equation 7]

$$\begin{aligned} Iel &= k_1\{Vth - k_2(Vdata - Vref) - Vth\}^2 \\ &= k_1k_2(Vref - Vdata)^2 \end{aligned} \quad (7)$$

In Equation 7, the term of the threshold voltage Vth is removed, and the current Iel is determined by the voltage Vdat of the data signal. Thus, a reduction in the display quality due to the threshold voltage Vth of the transistor 121 can be suppressed.

In the embodiment, actually, as illustrated in Equation 1, the voltage amplitude from the lowest value to the maximum value of the voltage Vdat of the data signal is compressed in accordance with a coefficient Ka, and is propagated to the gate node g.

In addition, in the first embodiment, the M level is supplied to the gate node of the transistor 124 in the light emission period (G), and the current Iel is limited, but the reduction in the display quality due to the threshold voltage Vth is still suppressed.

Next, in the first embodiment, the usefulness of applying the M level to the gate node of the transistor 124 in the light emission period (G) will be described.

The reason for applying the M level to the gate node of the transistor 124 is to maintain constant current properties by the transistor 121 regardless of a secular change of current-voltage characteristics of the OLED 130 by operating the transistor 124 in a saturation region.

Specifically, when the current Iel flows, the OLED 130 emits light with luminance corresponding to the current Iel. In the pixel circuit 110 of the first embodiment, the constant current property of the current Iel flowing from the feed line 116 to the OLED 130 is ensured by holding the voltage of the gate node g in the transistor 121 by the capacitance element 140.

However, in the OLED 130, element characteristics change with the passage of light emission time, and a potential of the anode (the pixel electrode 131) required for causing a constant current to flow gradually increases. When the potential of the anode in the OLED 130 increases, an equilibrium point of the potential in a path from the feed line 116 to the common electrode 133 changes, and the potential of the source node of the transistor 124, that is, the drain node of the transistor 121 increases. When the potential of the drain node of the transistor 121 increases, the voltage between the source node and the drain node in the transistor 121 also fluctuates, and the current flowing through the drain node of the transistor 121 also fluctuates, and thus the constant current property of the OLED 130 is impaired.

Therefore, in the first embodiment, the transistor 124 is operated in the saturation region as a measure to prevent the constant current property from being impaired due to the secular change of the element characteristics of the OLED 130.

When the transistor 124 is operated in the saturation region, it is the transistor 124 that directly receives the effect, even when the potential of the anode in the OLED 130 changes. The transistor 121 is influenced by the potential variation in the drain node of the transistor 124, but a variation in the drain current in the saturation region is small. Thus, the effects due to the variation in the drain potential of the transistor 121 coupled to the transistor 124, and thus the variation of the gate potential by a current leak, are mitigated.

Further, in the first embodiment, the discharge period (F) is provided after the compensation period (D) and before the light emission period (G).

The drain node d of the transistor 121 converges to the voltage (Vel–Vth) corresponding to the threshold voltage Vth at the end of the compensation period (D), and is in a state in which the voltage (Vel–Vth) is held by a parasitic capacitance. That is, in the drain node d of the transistor 121, an electric charge remains at the end of the compensation period (D). When the light emission period (G) is reached without providing the discharge period (F), the transistor 121 cannot cause the current Iel corresponding to the voltage Vgs between the gate node and the source node to appropriately flow due to the influence of the electric charge remaining in the drain node.

Specifically, in the writing period (E), even when a data signal corresponding to a gradation level of zero is held in the gate node g of the transistor 121, there may be a phenomenon in which a current flows through the OLED 130 due to the remaining electric charge and a slight amount of light is emitted. This phenomenon may be referred to as black floating because the OLED 130 emits light and is visually recognized as if black were floating even when black should be expressed.

On the other hand, in the first embodiment, the reset voltage Vorst is applied to the drain node d of the transistor 121 in the discharge period (F), and the electric charge remaining from the end of the compensation period (D) is reset. Thus, in the first embodiment, the black floating can be suppressed, and the reduction in display quality can be suppressed.

In the first embodiment, since the number of transistors in the pixel circuit 110 is "4", and the reset voltage Vorst is supplied via the data line 14*b* in the display region 100, the complication of the configuration can be avoided as compared to a case in which the reset voltage Vorst is supplied to the pixel circuit 110 through a dedicated feed line.

In the electro-optical device 10, since the pixel circuit 110 is driven by the control circuit 20, the data signal output circuit 30, the switch group 40, the capacitance element group 50, the initialization circuit 60, the auxiliary circuit 70, and the scanning line drive circuit 120, they can be conceptualized as a drive circuit of the pixel circuit 110.

Second Embodiment

Next, an electro-optical device 10 according to a second embodiment will be described. The second embodiment is different from the first embodiment in the following points. Specifically, the second embodiment is different from the first embodiment in terms of a configuration of the pixel circuit 110, a configuration of the display region 100, waveforms of the scanning signal and the control signal.

Thus, the second embodiment will mainly explain the difference from the first embodiment, and the same elements as those of the first embodiment will be designated by the same reference numerals, and the description thereof will be omitted as appropriate.

Figure 14:
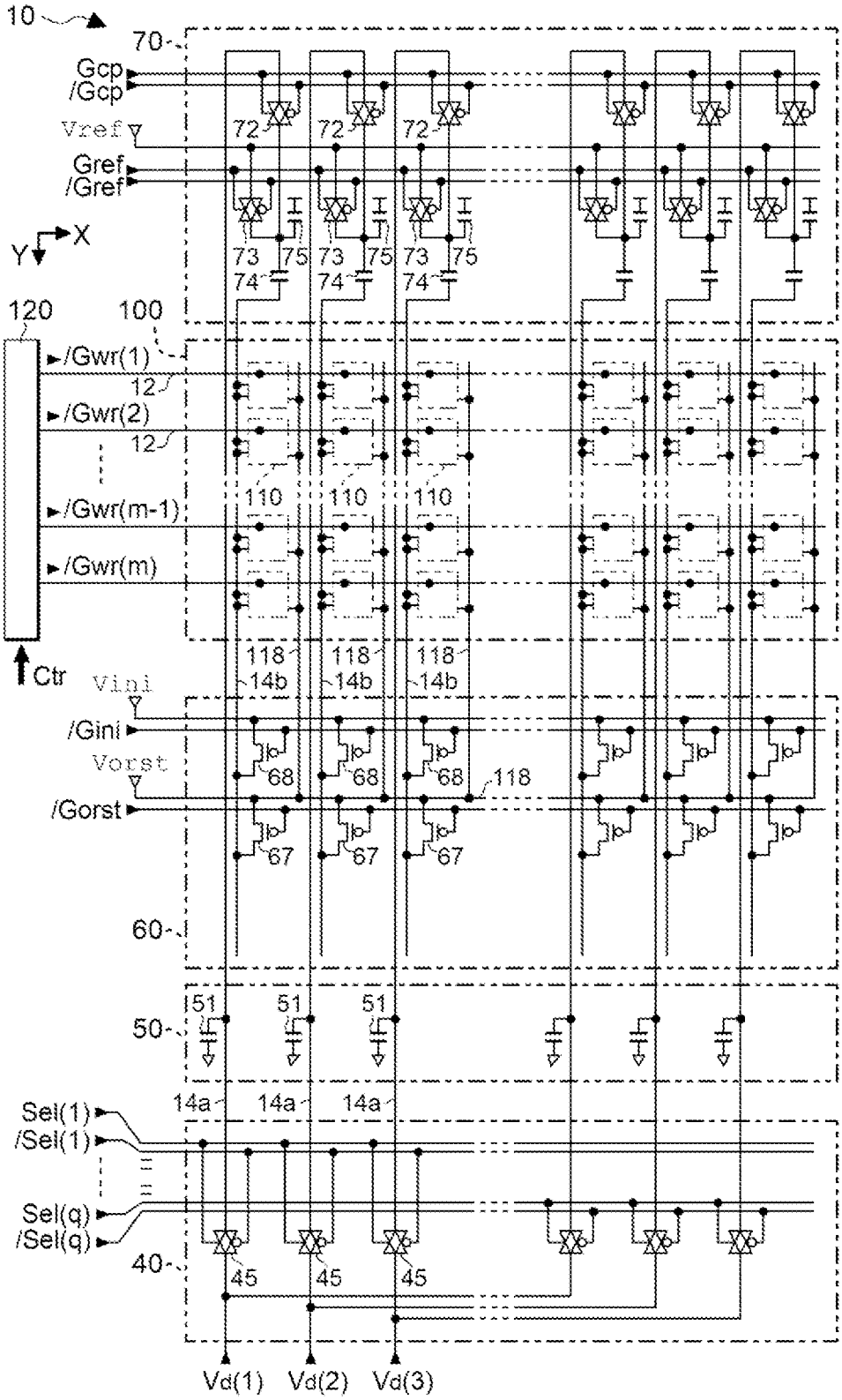
FIG. 14 is a block diagram illustrating an electrical configuration of an electro-optical device according to a second embodiment.
Figure 15:
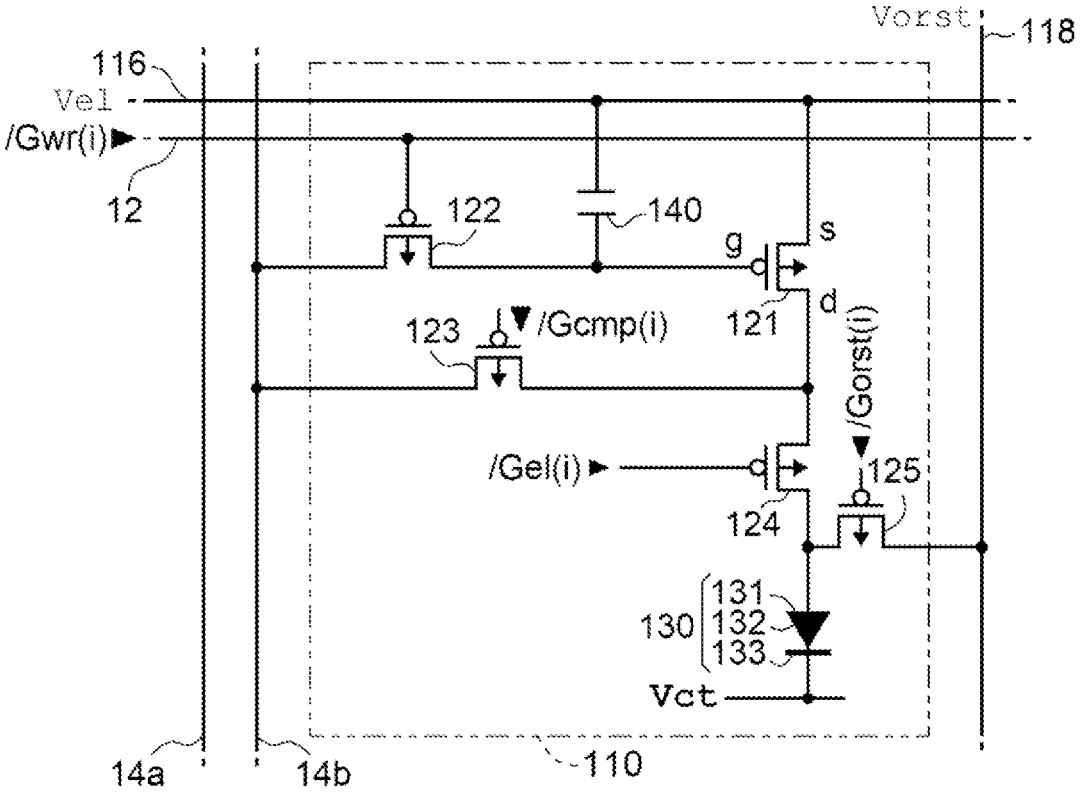
FIG. 15 is a diagram illustrating a pixel circuit in the electro-optical device.

FIG. 14 is a circuit diagram illustrating a part of the electro-optical device 10 according to the second embodiment, and FIG. 15 is a diagram illustrating a configuration of a pixel circuit 110 according to the second embodiment.

The circuit shown in FIG. 14 is different from the circuit shown in FIG. 3 in that the initialization circuit 60 does not have the transistor 66 provided for each of the data lines 14*b*, and the feed line 118 extends to the display region 100 and the reset voltage Vorst is supplied to each of the pixel circuits 110.

In the second embodiment, since the transistor 66 is not provided, the supply of the control signal /Drst by the control circuit 20 is omitted. Although the omitted control signal /Drst was common to each row, in the second embodiment, control signals /Gorst(1) to /Gorst(m) corresponding to the first to m-th row are instead supplied by the scanning line drive circuit 120.

In the second embodiment, the common control signal /Gorst in each row is supplied from the control circuit 20 in the same manner as in the first embodiment.

FIG. 15 is a diagram illustrating a configuration of the pixel circuit 110 in the second embodiment. The circuit illustrated in FIG. 15 is different from the circuit illustrated in FIG. 4 in that a transistor 125 is provided. In particular, the transistor 125 is a P channel MOS type similar to the transistors 121 to 124.

In the pixel circuit 110 in the i-th row and any one column, a source node of the transistor 125 is coupled to the pixel electrode 131 and the drain node of the transistor 124, and a drain node of the transistor 125 is coupled to the feed line 118 extending to the display region 100. A control signal /Drst(i) corresponding to the i-th row is supplied to the gate node of the transistor.

Figure 16:
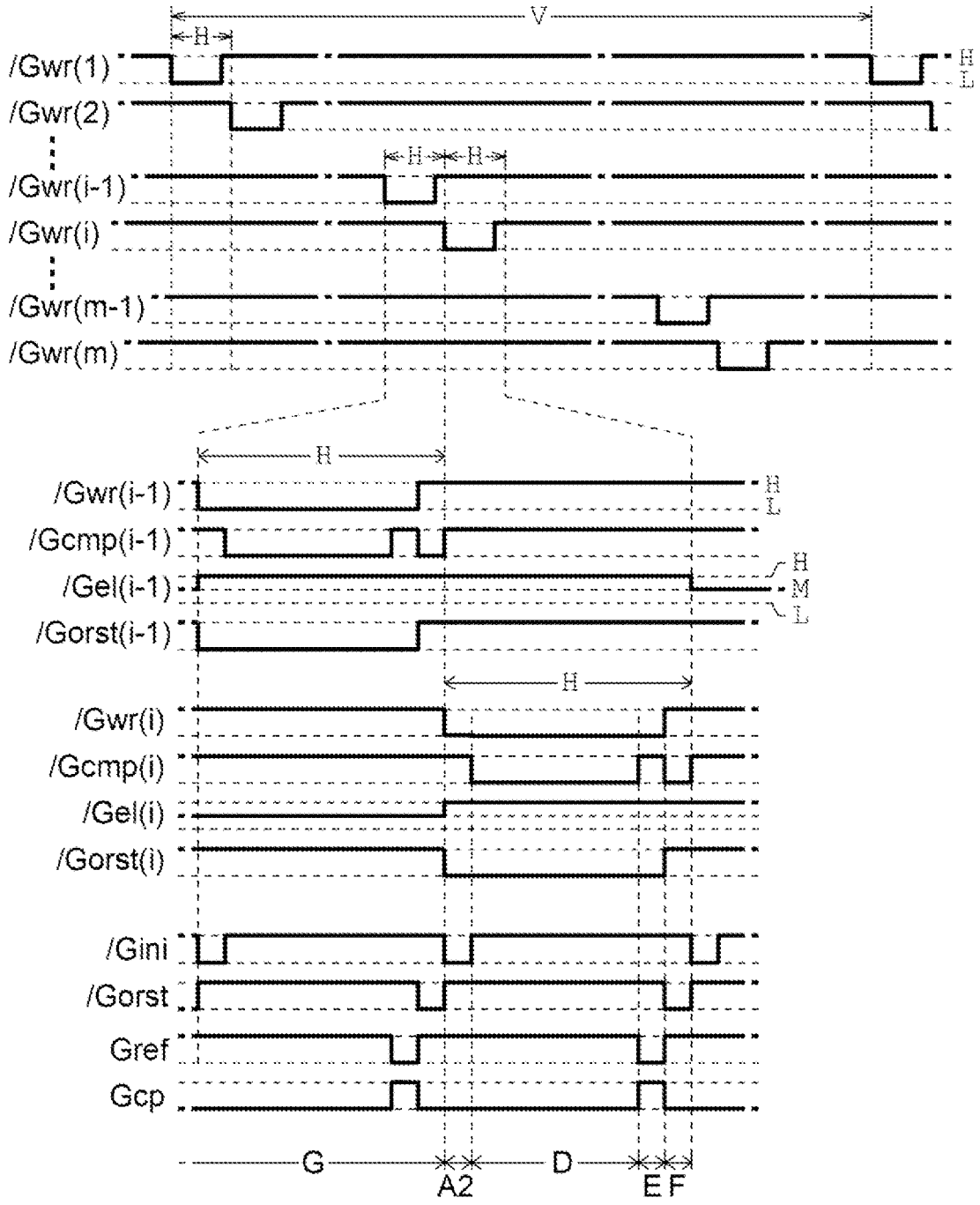
FIG. 16 is a timing chart illustrating an operation of the electro-optical device.

FIG. 16 is a timing chart for describing an operation of the electro-optical device 10 according to the second embodiment.

In this electro-optical device 10, the horizontal scanning period (H) is divided into four periods of an initialization period (A2), a compensation period (D), a writing period (E), and a discharge period (F) in the order of time. That is, in the second embodiment, there are no initialization periods (B) and (C) as in the first embodiment. Further, as the operation of the pixel circuit 110, the light emission period (G) is further applied to the four periods described above.

The initialization period (A2) is performed in parallel with a process for resetting the potential at the anode of the OLED 130, and a process for applying the voltage Vini for causing the transistor 121 to be in the ON state in the beginning of the compensation period (D) to the gate node g.

In the initialization period (A2) of each of the horizontal scanning periods (H), the control signal /Gini is at the L level, the control signal /Gorst is at the H level, the control signal Gref is at the H level, and the control signal Gcp is at the L level. Thus, the transistor 68 is in the OFF state, the transistor 67 is in the OFF state, the transmission gate 73 is in the ON state, and the transmission gate 72 is in the OFF state.

Further, in the initialization period (A2) of the horizontal scanning period (H) in which the i-th row is selected, the scanning signal /Gwr(i) is at the L level, the control signal /Gcmp(i) is at the H level, the control signal /Gel(i) is at the H level, the control signal /Gcmp(i) is the H level, the control signal /Gel(i) is at the H level, and the control signal /Gorst(i) is at the L level. Thus, in the pixel circuit 110, the transistor 122 is turned into the ON state, the transistors 123 and 124 are in the OFF state, and the transistor 125 is in the ON state.

Figure 17:
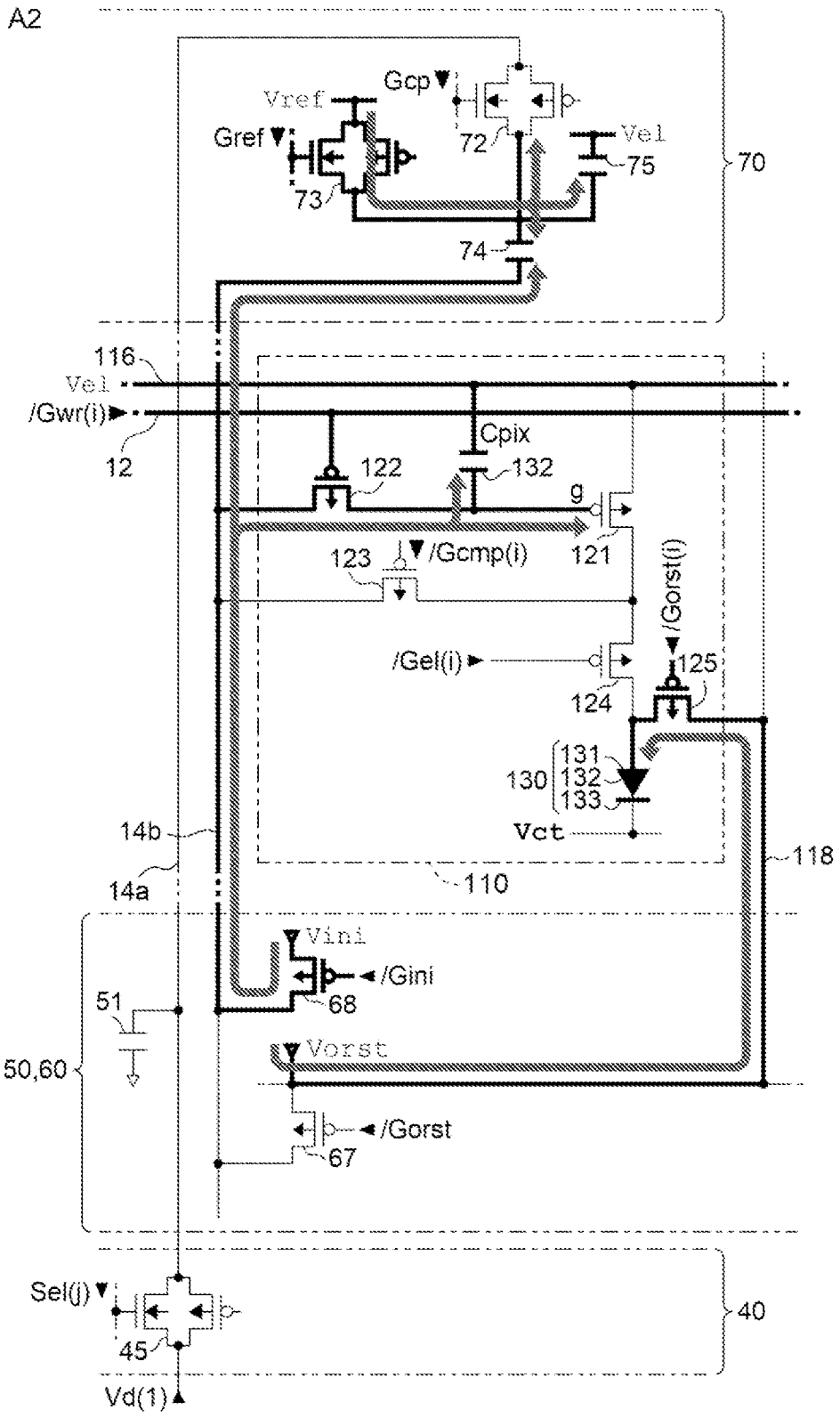
FIG. 17 is a diagram for describing the operation of the electro-optical device.

Thus, in the initialization period (A2), the voltage Vref is applied to one end of the capacitance element 74, one end of the capacitance element 75 and the output terminal of the transmission gate 72, as illustrated in FIG. 17.

In the pixel circuit 110, the voltage Vini is applied to one end of the capacitance element 140 and the gate node g of the transistor 121 via the transistor 68, the data line 14*b*, and the transistor 122 in order. Since the voltage Vini is applied to the other end of the capacitance element 74 via the data line 14*b*, the capacitance element 74 is charged to a voltage |Vini−Vref|. Further, in the pixel circuit 110, the reset voltage Vorst is applied to the pixel electrode 131, which is the anode of the OLED 130, via the feed line 118 and the transistor 125 in order. Thus, a voltage held in the capacitance component of the OLED 130, specifically, a voltage corresponding to the current flowing through the OLED 130 during the light emission period (G) is reset.

In the compensation period (D) of each of the horizontal scanning periods (H), the control signal /Gini reaches the H level, the control signal /Gorst is at the H level, the control signal Gref is at the H level, and the control signal Gcp is at the L level. Thus, the transistor 68 changes to the OFF state, the transistor 67 maintains the OFF state, the transmission gate 73 maintains the ON state, and the transmission gate 72 maintains the OFF state.

Thus, the transistor 68 changes to the OFF state, the transistor 67 maintains the OFF state, the transmission gate 73 maintains the ON state, and the transmission gate 72 maintains the OFF state.

In the compensation period (D) of the horizontal scanning period (H) in which the i-th row is selected, the scanning signal /Gwr(i) is at the L level, the control signal /Gcmp(i) is at the H level, the control signal /Gel(i) is at the H level, and the control signal /Gorst(i) is at the L level.

Thus, in the pixel circuit 110, the transistor 122 maintains the ON state, the transistor 123 changes to the ON state, the transistor 124 maintains the OFF state, and the transistor 125 maintains the ON state.

Figure 18:
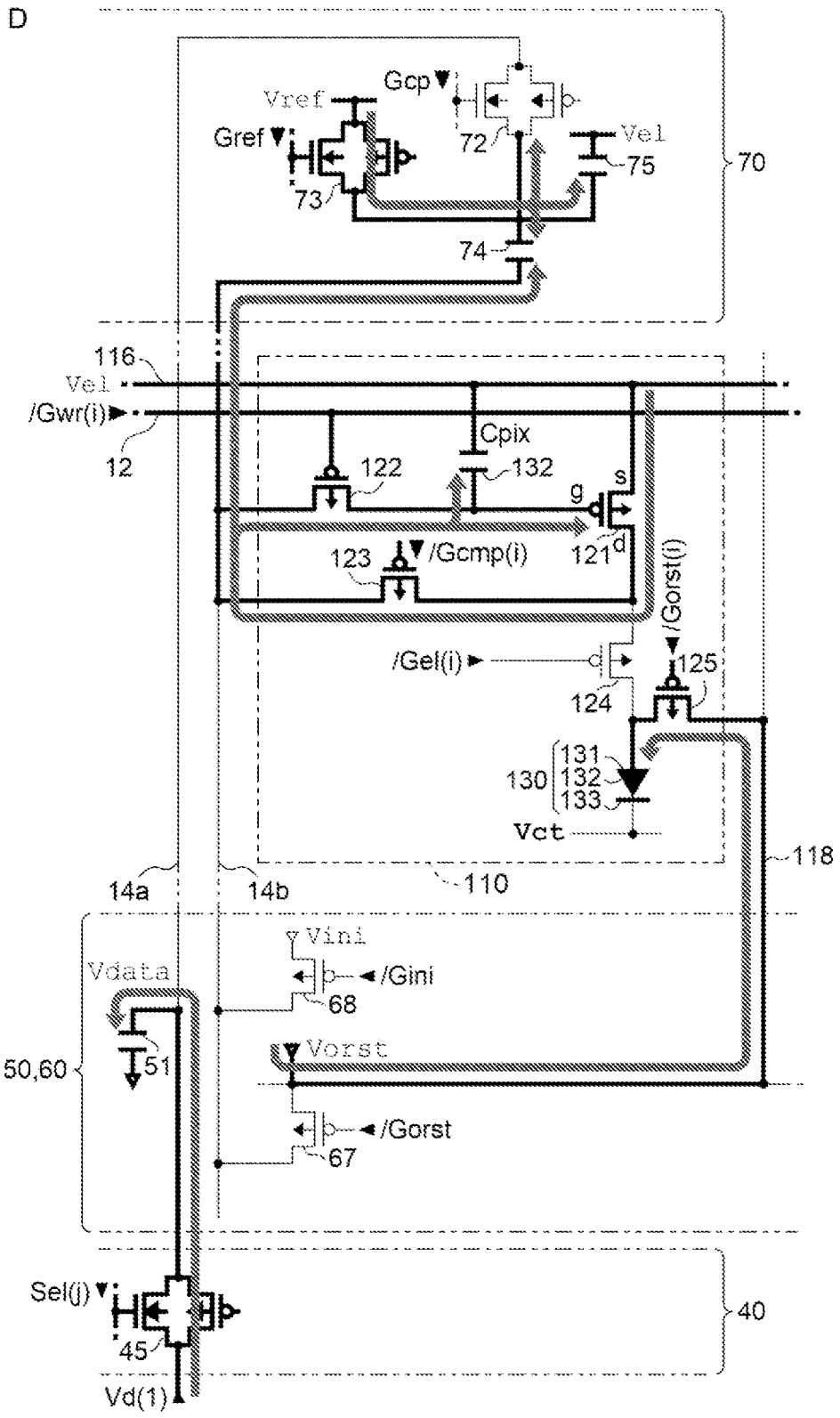
FIG. 18 is a diagram for describing the operation of the electro-optical device.

Thus, in the compensation period (D), as illustrated in FIG. 18, one end of the capacitance element 74, one end of the capacitance element 75, and the output terminal of the transmission gate 72 are maintained at the voltage Vref.

In the pixel circuit 110, the capacitance element 140 is in a state in which a voltage (Vel−Vini) between the gate node and the source node of the transistor 121 is held during the initialization period (A2), and in this state, when the transistors 122 and 123 are turned into the ON state, the transistor 121 is in a diode coupled state. Thus, the gate node g of the transistor 121 converges to the voltage (Vel−Vth) corresponding to the threshold voltage Vth.

Furthermore, in the compensation period (D), since the other ends of the data line 14*b* and the capacitance element 74 converges to the voltage (Vel−Vth), the capacitance element 74 is charged to a voltage |Vel−Vth−Vref|.

In the compensation period (D), in the pixel circuit 110, since the transistor 125 maintains the ON state, the reset voltage Vorst is applied to the pixel electrode 131.

In the compensation period (D), the control signals Sel(1) to Sel(q) sequentially and exclusively reach the H level. Furthermore, the data signal output circuit 30 outputs data signals Vd (1) to Vd (3) of three pixels corresponding to the intersections between the scanning line 12 on the i-th row and the data line 14*b* belonging to the j-th group, for example, when the control signal Sel(j) among the control signals Sel(1) to Sel(q) reaches the H level When the control signals Sel(1) to Sel(q) sequentially and exclusively reach the H level, the voltage of the data signal corresponding to each pixel is held in the capacitance element 51 corresponding to the first column to the (3q)-th column. FIG. 18 illustrates a state in which the control signal Sel(j) corresponding to the j-th group to which the pixel circuit 110 belongs reaches the H level in the compensation period (D), and the voltage Vdat of the data signal Vd(1) is held in the capacitance element 51.

In the writing period (E) of each of the horizontal scanning periods (H), the control signal /Gini is at the H level, the control signal /Gorst is at the H level, the control signal Gref is at the L level, and the control signal Gcp reaches the H level. Thus, the transistors 68 and 67 maintain the OFF state, the transmission gate 73 changes to the OFF state, and the transmission gate 72 changes to the ON state.

Further, in the writing period (E) of the horizontal scanning period (H) in which the i-th row is selected, the scanning signal /Gwr(i) is at the L level, the control signal /Gcmp(i) reaches the H level, the control signal /Gel(i) is at the H level, and the control signal /Gorst(i) is at the L level.

Thus, in the pixel circuit 110, the transistor 122 maintains the ON state, the transistor 123 changes to the OFF state, the transistor 124 maintains the OFF state, and the transistor 125 maintains the ON state.

Figure 19:
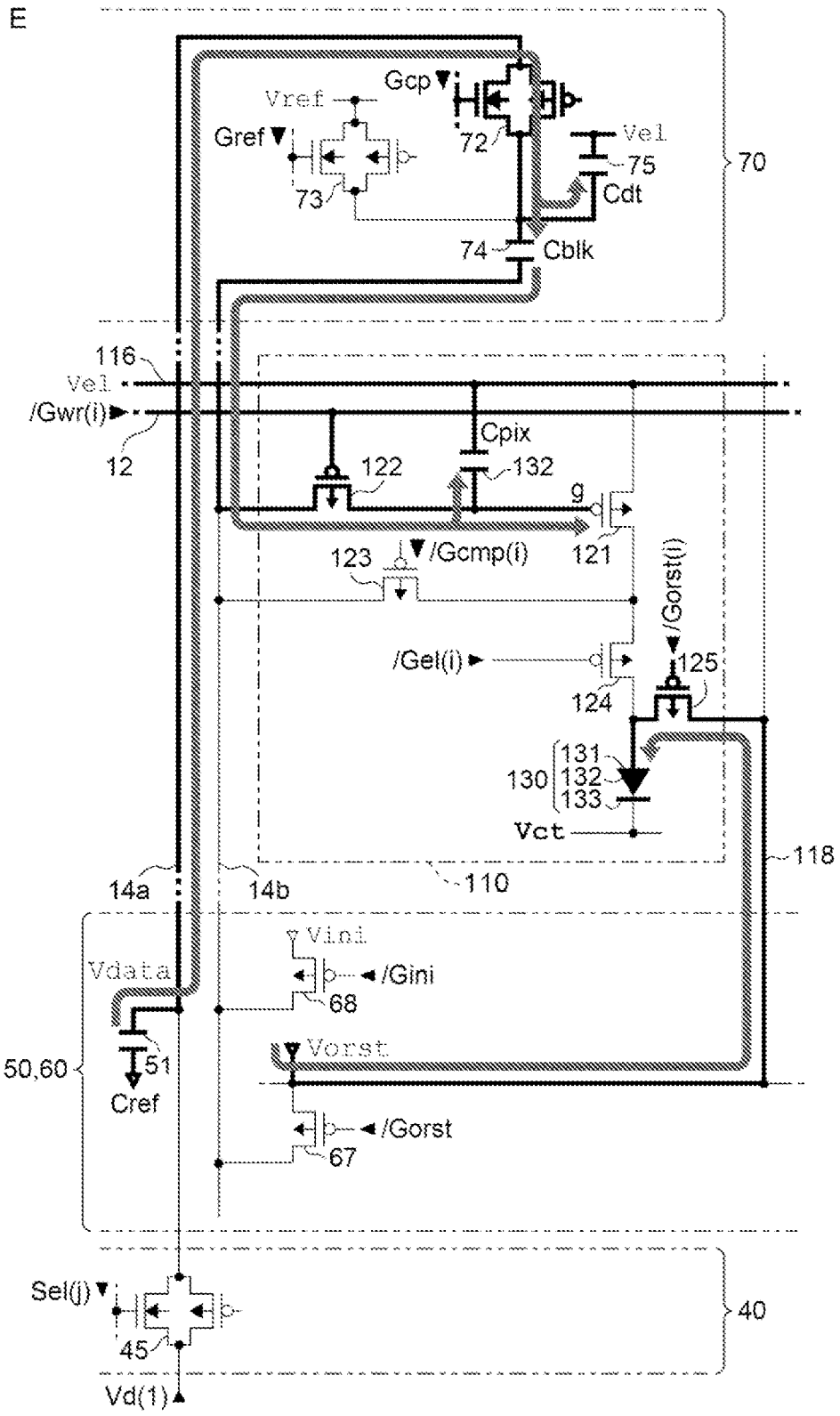
FIG. 19 is a diagram for describing the operation of the electro-optical device.

Thus, in the writing period (E) of the horizontal scanning period (H) in which the i-th row is selected, as illustrated in FIG. 19, one end of the capacitance element 74 changes from the voltage Vref in accordance with the voltage held at one end of the capacitance element 51. The voltage change is propagated to the gate node g via the capacitance element 74, the data line 14*b*, and the transistor 122 in order. The voltage of the gate node g after the change is held in the capacitance element 140.

In the writing period (E), in the pixel circuit 110, since the transistor 125 maintains the ON state, the reset voltage Vorst is applied to the pixel electrode 131.

In the discharge period (F) of each of the horizontal scanning periods (H), the control signal /Gini is at the H level, the control signal /Gorst is at the L level, the control signal Gref is at the H level, and the control signal Gcp reaches the L level. Thus, the transistor 68 maintains the OFF state, and the transistor 67 changes to the ON state. Also, the transmission gate 73 maintains the OFF state, and the transmission gate 72 changes to the OFF state.

Further, in the discharge period (F) of the horizontal scanning period (H) in which the i-th row is selected, the scanning signal /Gwr(i) changes to the H level, the control signal /Gcmp(i) changes to the L level, and the control signal /Gel(i) maintains the H level.

Thus, in the pixel circuit 110, the transistor 122 changes to the OFF state, the transistor 123 changes to the ON state, and the transistor 124 maintains the OFF state.

Figure 20:
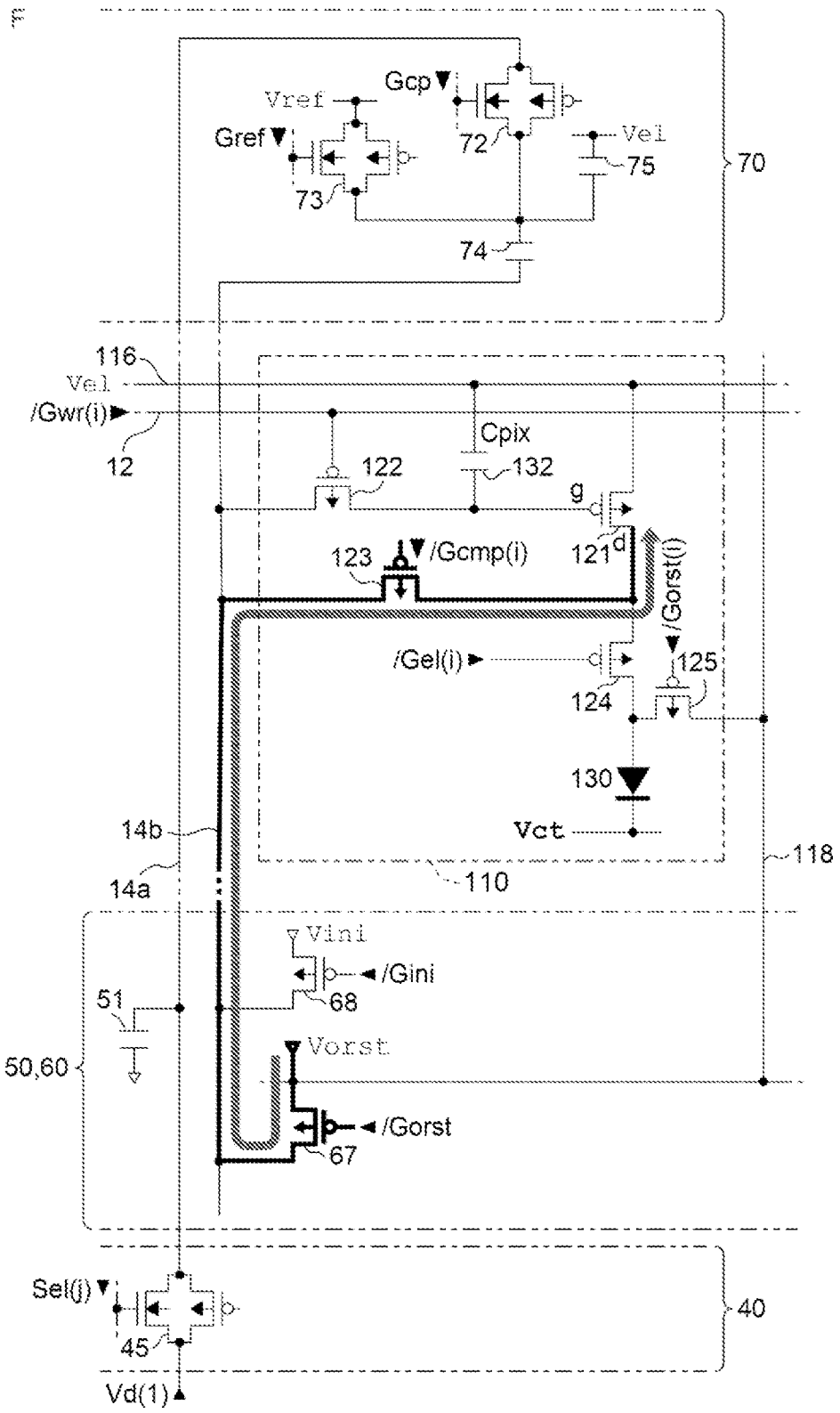
FIG. 20 is a diagram for describing the operation of the electro-optical device.

Thus, in the discharge period (F) of the horizontal scanning period (H) in which the i-th row is selected, as illustrated in FIG. 20, the reset voltage Vorst is applied to the drain node of the transistor 121 via the transistor 67 in the ON state, the data line 14*b*, and the transistor 123 in the ON state in order. Thus, the reset voltage Vorst is applied to the drain node of the transistor 121.

Figure 21:
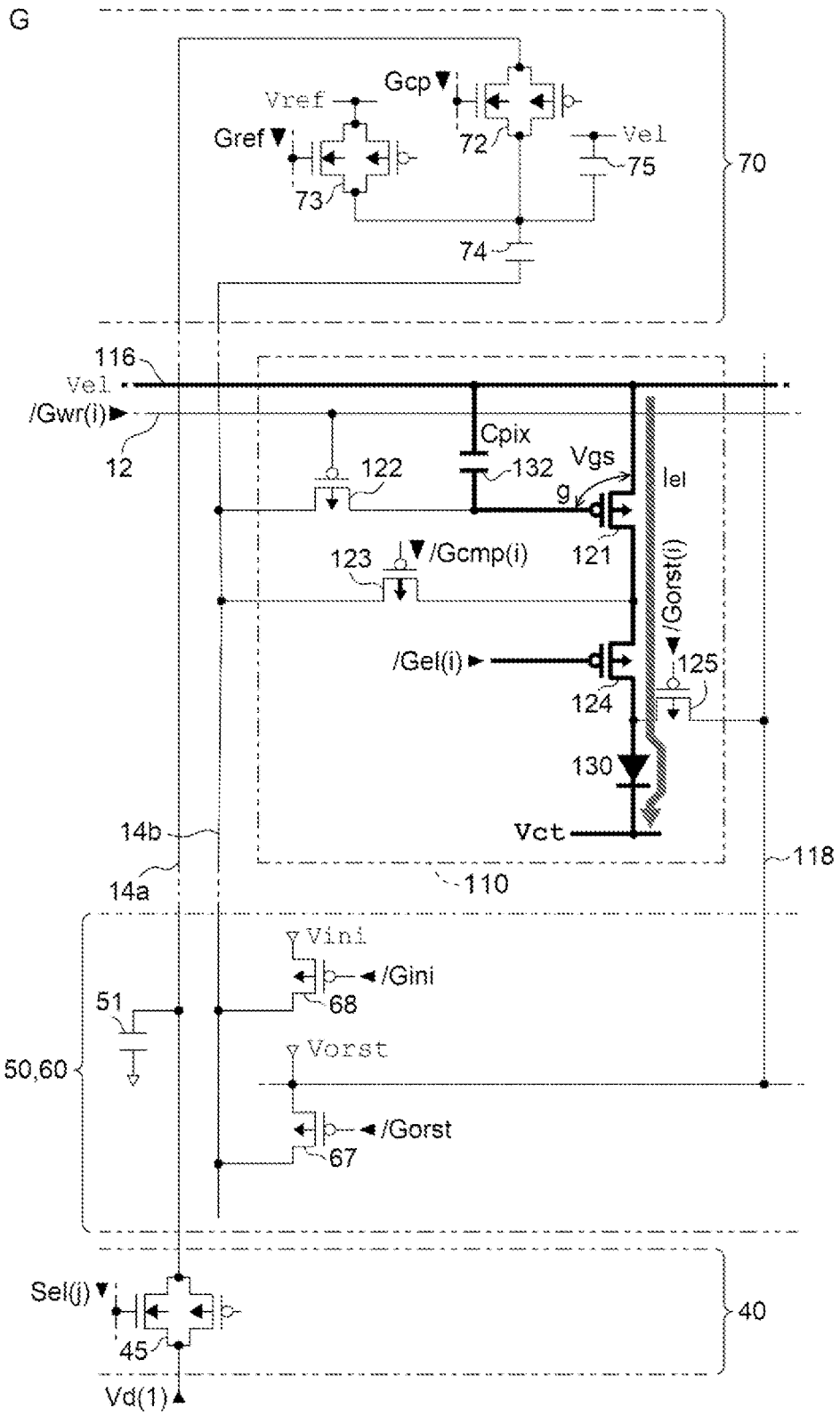
FIG. 21 is a diagram for describing the operation of the electro-optical device.

After the end of the discharge period (F), the light emission period (G) is reached. In the second embodiment, similarly to the first embodiment, the control signal /Gel(i) reaches the M level in the light emission period of the i-th row. Thus, as shown in FIG. 21, the transistor 121 causes the current Iel limited by the resistance between the source and the drain in the transistor 124, which is the current Iel corresponding to the voltage Vgs, to flow through the OLED 130. Therefore, the OLED 130 emits light at luminance in accordance with the current Iel.

According to the second embodiment, similarly to the first embodiment, since the electric charge remaining from the end of the compensation period (D) is reset by applying the reset voltage Vorst to the drain node of the transistor 121 in the discharge period (F), black floating is suppressed, and a reduction in display quality can be suppressed.

In addition, according to the second embodiment, since the initialization periods (B) and (C) in the first embodiment are not provided, the compensation period (D) can be sufficiently ensured.

When the compensation period (D) is short, a situation in which the voltage Vgs between the gate node and the source node of the transistor 121 does not converge to the threshold voltage may occur at the end of the compensation period (D). In the situation in which the voltage Vgs does not converge to the threshold voltage, the threshold value of the transistor 121 cannot be accurately compensated for, and thus the luminance of the OLED 130 varies with respect to each of the pixel circuit 110, which leads to the reduction in display quality.

According to the second embodiment, since the compensation period (D) can be sufficiently ensured, compared to the first embodiment, the threshold value of the transistor 121 can be compensated for more precisely. Thus, according to the second embodiment, it is possible to further suppress the reduction in display quality compared to the first embodiment.

In the second embodiment, the period in which the reset voltage Vorst is applied to the pixel electrode 131, which is one end of the OLED 130, is the initialization period (A2), the compensation period (D), and the writing period (E), but are not limited to the periods. The period in which the reset voltage Vorst is applied to the pixel electrode 131 may be a period before the light emission period (G), and thus may be, for example, a part of the initialization period (A2), the compensation period (D), and the writing period (E), or may be the discharge period (F).

However, for example, in the horizontal scanning period (H) in which the i-th row is selected, it is preferable to include the horizontal scanning period (A2) from the viewpoint of promptly resetting the electric charge held in the pixel electrode 131 and turning off the OLED 130.

In the second embodiment, in describing the point of applying the reset voltage Vorst to the pixel electrode 131 from a different point of view, applying the reset voltage Vorst to the drain node d of the transistor 121 is the transistor 123, and different from the transistor 125 for applying the reset voltage Vorst to the pixel electrode 131 of the light emitting element 130.

Thus, in the second embodiment, the application of the reset voltage Vorst to the pixel electrode 131 can be performed without relying on the ON state of the transistor 123. For example, in the second embodiment, the transistor 123 is in the ON state during the compensation period (D) and the discharge period (F), but even during the compensation period (D) and the discharge period (F), the application of the reset voltage Vorst to the pixel electrode 131 is enabled by the ON state of the transistor 125.

Modified Example

The first embodiment and the second embodiment (hereinafter, referred to as embodiments and the like) exemplified above can be variously modified. Specific modification aspects that may be applied to the embodiments are exemplified below. Two or more modes arbitrarily selected from the following exemplifications below can be appropriately combined in the extent that mutual contradiction does not arise.

Figure 22:
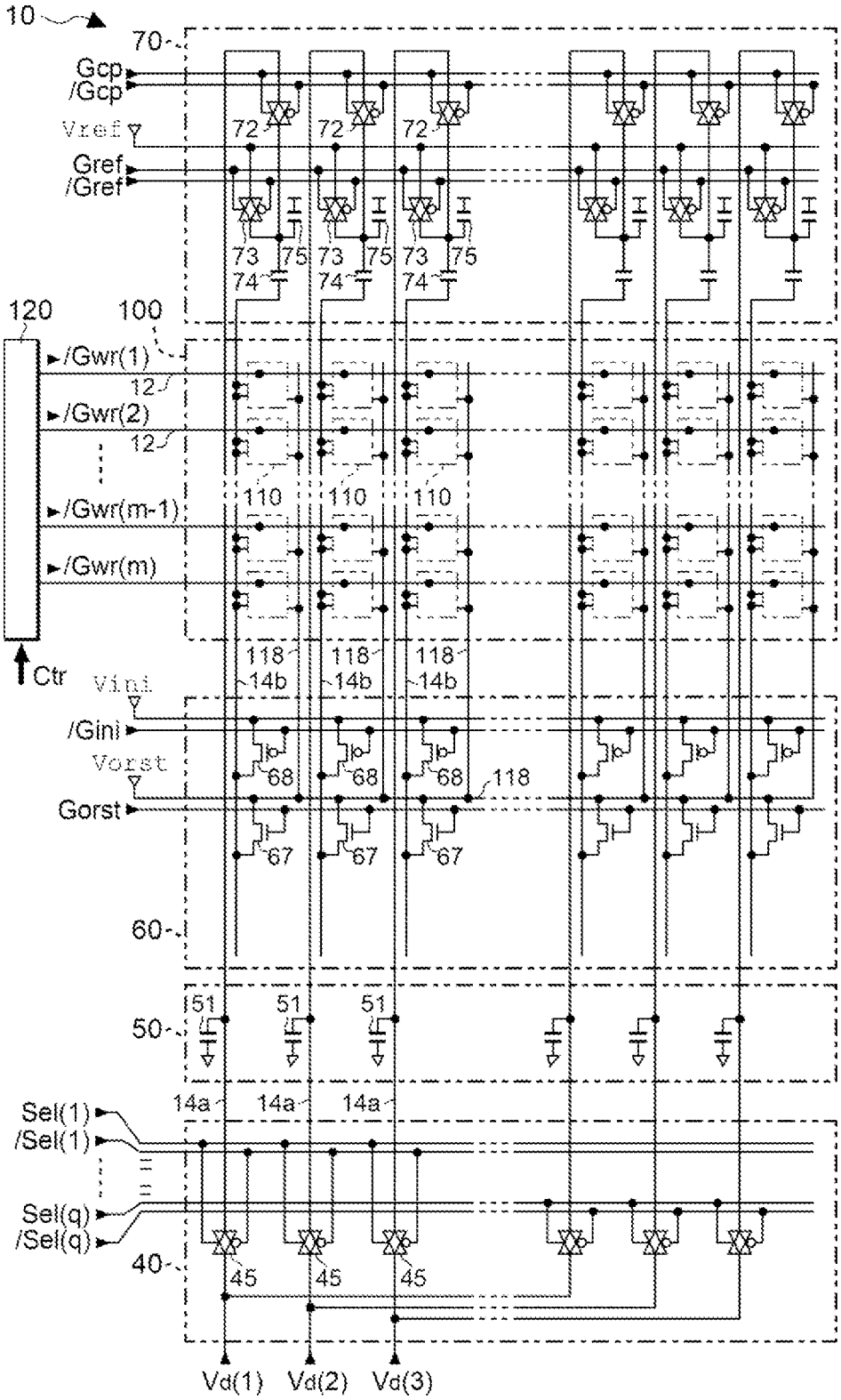
FIG. 22 is a diagram illustrating a pixel circuit of the electro-optical device according to a modified example.
Figure 23:
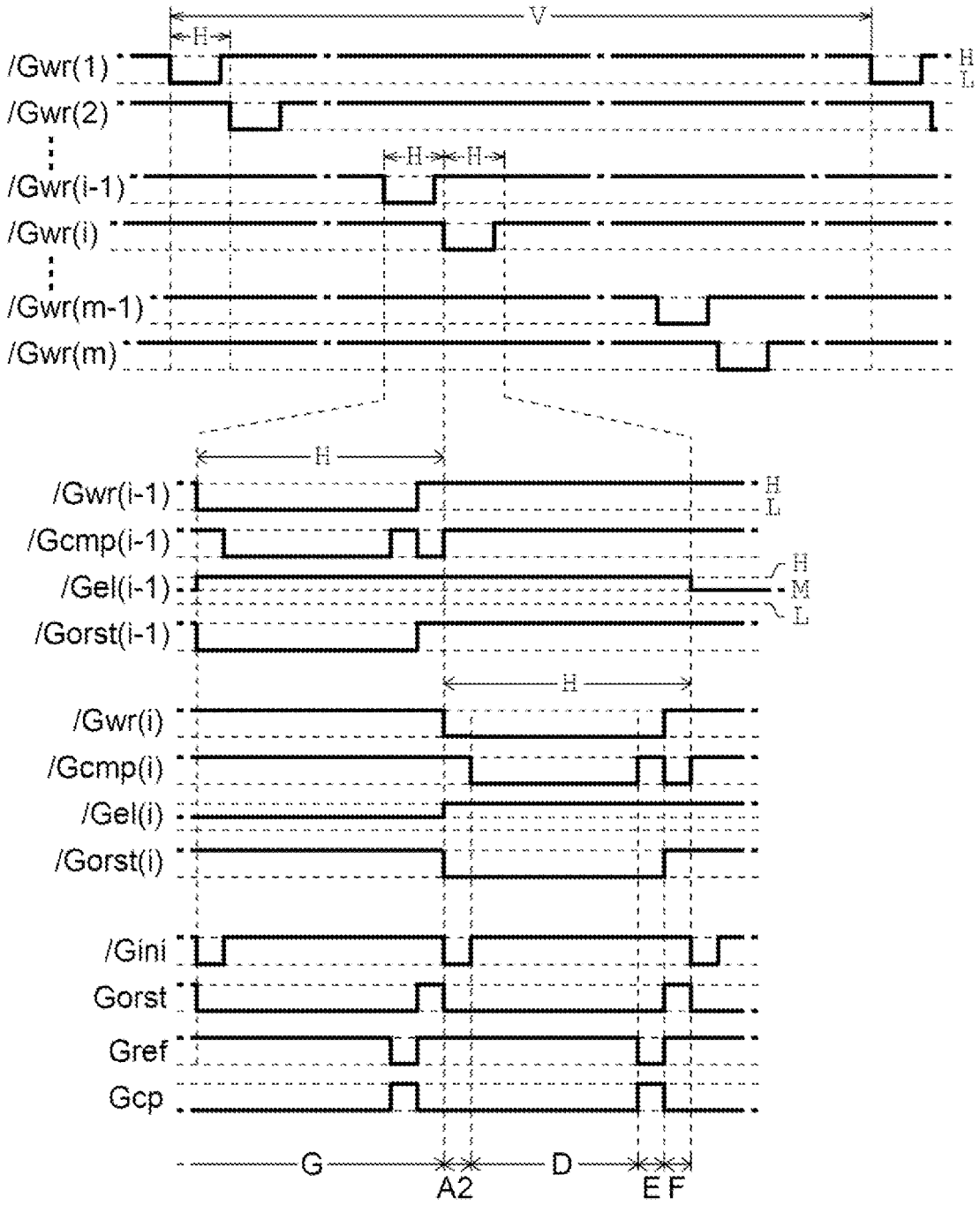
FIG. 23 is a timing chart illustrating an operation of the electro-optical device.

The channel types of transistors 66, 67, 68, and 121 to 125 are not limited to the embodiments and the like. For example, the transistor 67 in the embodiments and the like is preferably an N-channel type. This is because the reset voltage Vorst supplied by the feed line 118 is a low voltage close to the L level. In the second embodiment, as illustrated in FIG. 22, in the configuration in which the transistor 67 is an N-channel type, a positive logic control signal Gorst may be supplied to the gate node as shown in FIG. 23. According to the configuration in which the transistor 67 is the N-channel type, the data line 14*b* can be set to the reset voltage Vorst in a short period of time compared to the configuration in which the transistor 67 is formed as a P-channel type. Although not specifically illustrated, the transistor 67 may be an N-channel type in the first embodiment (refer to FIG. 3). In the configuration in which the transistor 67 is the N-channel type in the first embodiment, a signal in which the/Gorst in FIG. 5 is logically inverted may be supplied to the gate node of the transistor 67.

Further, the transmission gates 45, 72, and 73 may be replaced by a single channel type transistor.

In the embodiments and the like, the OLED 130 has been described as an example of the light emitting element, but other light emitting elements may be used. For example, an LED, a mini LED, a micro LED, or the like may be used as the light emitting element.

Electronic Apparatus

Next, an electronic apparatus to which the electro-optical device 10 according to the above-described embodiments is applied will be described. The electro-optical device 10 is suitable for application with a small size pixel and high definition display. Therefore, a head-mounted display will be described as an example of the electronic apparatus.

Figure 24:
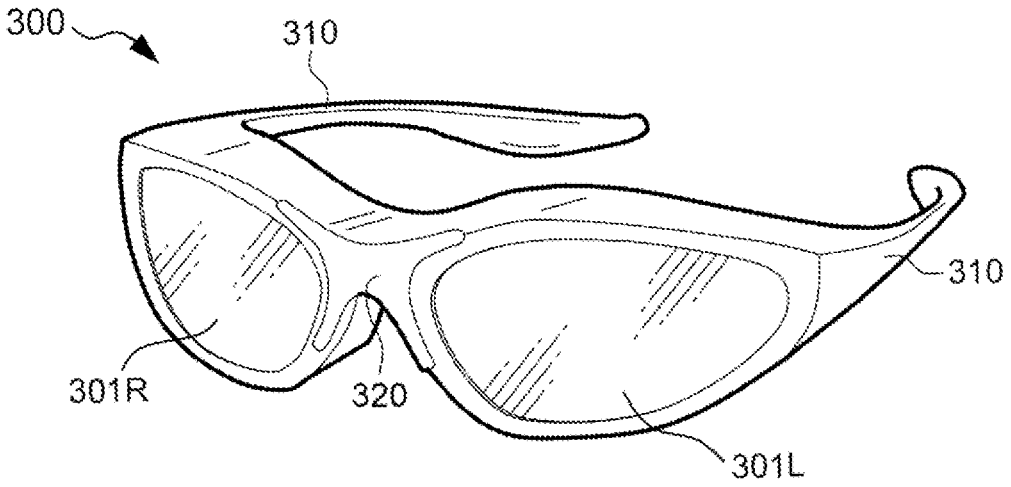
FIG. 24 is a perspective view illustrating a head-mounted display using an electro-optical device.
Figure 25:
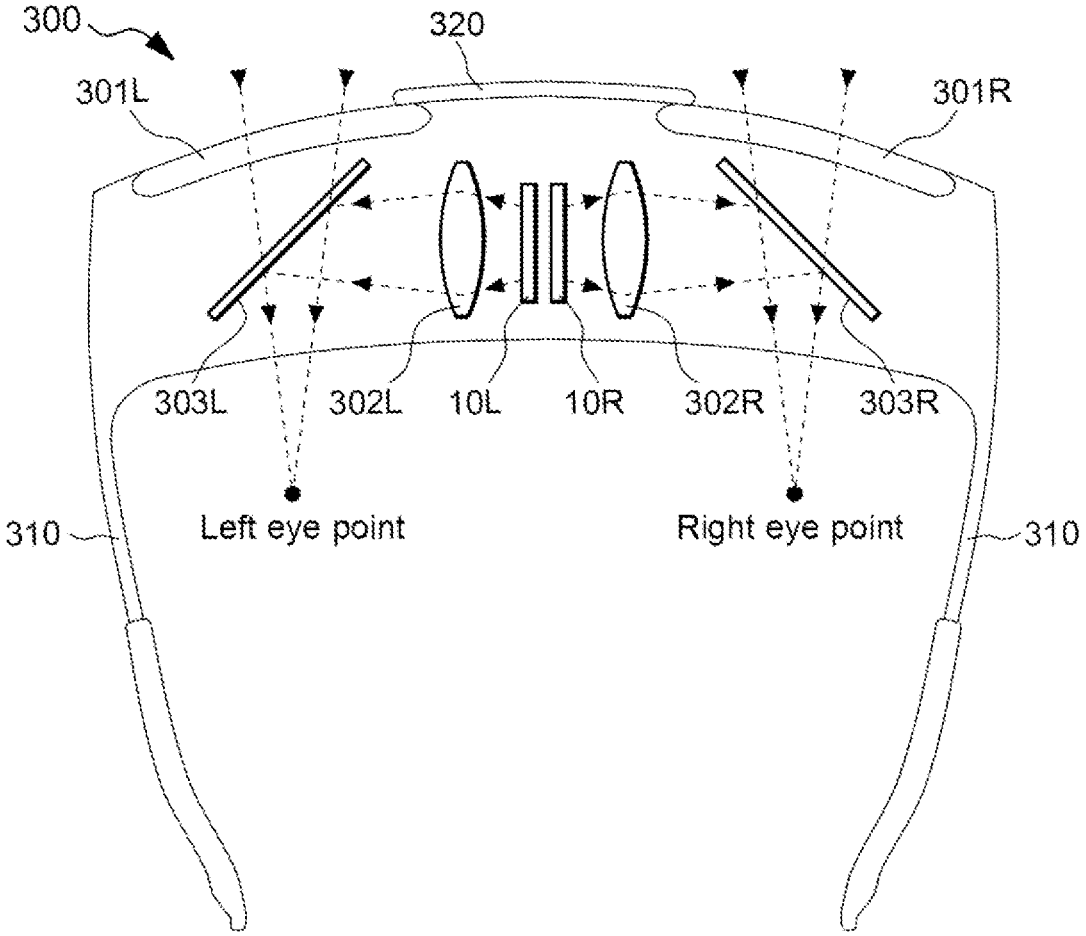
FIG. 25 is a diagram illustrating an optical configuration of the head-mounted display.

FIG. 24 is a view illustrating an exterior of a head-mounted display, and FIG. 25 is a view illustrating an optical configuration of the head-mounted display.

As illustrated in FIG. 24, the head-mounted display 300 includes, in terms of appearance, temples 310, a bridge 320, and lenses 301L and 301R, as with typical eye glasses. In addition, as illustrated in FIG. 25, the head-mounted display 300 is provided with an electro-optical device 10L for a left eye and an electro-optical device 10R for a right eye in the vicinity of the bridge 320 and on the back side (the lower side in the drawing) of the lenses 301L and 301R.

An image display surface of the electro-optical device 10L is disposed to be on the left side in FIG. 25. According to such a configuration, a display image by the electro-optical device 10L is output via an optical lens 302L in a 9-o'clock direction in the drawing. A half mirror 303L reflects the display image by the electro-optical device 10L in a 6-o'clock direction, while the half mirror 303L transmits light entering in a 12-o'clock direction. An image display surface of the electro-optical device 10R is disposed on the right side opposite to the electro-optical device 10L. According to such a configuration, a display image by the electro-optical device 10R is output via an optical lens 302R in a 3-o'clock direction in the drawing. A half mirror 303R reflects the display image by the electro-optical device 10R in a 6-o'clock direction, while the half the mirror 303R transmits light entering in a 12-o'clock direction.

In such a configuration, a wearer of the head-mounted display 300 can observe the display images by the electro-optical devices 10L and 10R in a see-through state in which the display images by the electro-optical devices 10L and 10R overlap the outside.

In addition, in the head-mounted display 300, among images for both eyes with parallax, an image for a left eye is displayed on the electro-optical device 10L, and an image for a right eye is displayed on the electro-optical device 10R, and thus, it is possible to cause the wearer to sense the displayed images as an image displayed having a depth or a three dimensional effect.

The electronic apparatus including the electro-optical device 10 can also be applied to an electronic viewfinder in a video camera or an interchangeable lens type digital camera, a mobile information terminal, a display part of a wristwatch, a light valve of a projection type projector, and the like, in addition to the head-mounted display 300.

Supplementary Note

A preferred aspect of the present disclosure is understood from the above description, for example, as follows. In order to facilitate understanding of each aspect, the reference numerals in the drawings are shown in parentheses below for convenience, but the present disclosure is not intended to be limited to the illustrated aspects.

APPENDIX 1

An electro-optical device (10) according to one aspect (Aspect 1) includes a pixel circuit (110) provided corresponding to a scanning line (12) and a data line (14*b*), and a first transistor (121) and a light emitting element (130) included in the pixel circuit (110), wherein the first transistor (121) is configured to supply a current (Iel) in accordance with a voltage (Vgs) between a gate node of the first transistor (121) and a source node of the first transistor (121) to the light emitting element (130), a horizontal scanning period (H) includes a compensation period (D), a writing period (E), and a discharge period (F) in order, in the compensation period (D), the gate node of the first transistor (121) and a drain node of the first transistor (121) are electrically coupled, and a voltage of the gate node of the first transistor (121) is set to a voltage (Vel−Vth) corresponding to a threshold voltage of the first transistor (121), in the writing period (E), the voltage of the gate node of the first transistor (121) is changed from the voltage (Vel−Vth) corresponding to the threshold voltage by a voltage corresponding to luminance of the light emitting element (130), in the discharge period (F), a reset voltage (Vorst) is applied to the drain node of the first transistor (121) via the data line (14*b*), and in a light emission period (G) after the discharge period (F), the current (Iel) in accordance with the voltage (Vgs) between the gate node of the first transistor (121) and the source node of the first transistor (121) is applied to the first transistor (121) and the light emitting element (130).

According to Aspect 1, due to the electrical connection of the gate node and the drain node in the first transistor (121) in the compensation period (D), the voltage (Vel−Vth) corresponding to the threshold voltage of the first transistor (121) is held in the drain node as well as the gate node by a parasitic capacitance or the like, but a reset voltage (Vorst) is applied to the drain node of the first transistor (121) in the discharge period (F) before the light emission period (G). Therefore, in the light emission period (G), black floating due to an electric charge remaining in the drain node is suppressed, and a reduction in display quality can be suppressed.

Further, since the reset voltage (Vorst) is applied to the drain node via the data line (14*b*), the pixel circuit (110) does not require a separate feed line for supplying the reset voltage (Vorst) to the drain node of the first transistor (121), and the complexity of the circuit configuration is avoided.

The transistor 121 is an example of the first transistor, and the OLED 130 is an example of the light emitting element.

APPENDIX 2

In an electro-optical device (10) according to a specific aspect of Aspect 1 (Aspect 2), the pixel circuit (110) includes a second transistor (122), a third transistor (123), and a fourth transistor (124), the second transistor (122) is provided between the data line (14*b*) and the gate node of the first transistor (121) and is in an ON state or an OFF state in accordance with a voltage of the scanning line (12), the third transistor (123) is provided between the data line (14*b*) and the drain node of the first transistor (121), the fourth transistor (124) is provided between the drain node of the first transistor (121) and the light emitting element (130), in the compensation period (D), the second transistor (122) and the third transistor (123) are in the ON state, in the writing period (E), the second transistor (122) is in the ON state, and the third transistor (123) is in the OFF state, in the discharge period (F), the second transistor (122) is in the OFF state, and the third transistor (123) is in the ON state, and in the light emission period (G), the second transistor (122) and the third transistor (123) are in the OFF state, and the fourth transistor (124) is in the ON state.

In Aspect 2, in the compensation period (D), the first transistor (121) is turned into a diode-coupled state due to the ON state of the third transistor (123), and in the discharge period (F), the reset voltage (Vorst) is applied via the data line (14*b*) to the drain node of the first transistor (121) due to the ON state of the third transistor (123). Thus, according to Aspect 2, since the number of transistors in the pixel circuit (110) is only "4", the reset voltage (Vorst) is supplied via the data line (14*b*), the complexity of configuration can be avoided.

The transistor 122 is an example of the second transistor, and the transistor 123 is an example of the third transistor, and the transistor 124 is an example of the fourth transistor.

APPENDIX 3

In an electro-optical device (10) according to a specific aspect of Aspect 1 (Aspect 3), the pixel circuit (110) includes a second transistor (121), a third transistor (123), a fourth transistor (124), and a fifth transistor (125), the second transistor (122) is provided between the data line (14*b*) and the gate node of the first transistor (121) and is in an ON state or an OFF state in accordance with a voltage of the scanning line (12), the third transistor (123) is provided between the data line (14*b*) and the drain node of the first transistor (121), the fourth transistor (124) is provided between the drain node of the first transistor (121) and the light emitting element (130), the fifth transistor (125) is provided between one end of the light emitting element (130) and a feed line (118) that supplies the reset voltage (Vorst), in the compensation period (D), the second transistor (122) and the third transistor (123) are in the ON state, in the writing period (E), the second transistor (122) is in the ON state, and the third transistor (123) is in the OFF state, in the discharge period (F), the second transistor (122) is in the OFF state, and the third transistor (123) is in the ON state, in the light emission period (G), the second transistor (122) and the third transistor (123) are in the OFF state, and the fourth transistor (124) is in the ON state, and in a period before the light emission period (G), the fifth transistor (125) is in the ON state.

According to Aspect 3, a transistor for applying the reset voltage (Vorst) to the drain node of the first transistor (121) is the third transistor (123), a transistor for applying the reset voltage (Vorst) to one end of light emitting element (130) is the fifth transistor (125), and both transistors are different from each other. Thus, the period for applying the reset voltage (Vorst) to one end of the light emitting element (130) can be set without relying on the ON state of the third transistor (123). For example, even in the compensation period (D) in which the third transistor (123) is in the ON state, the fifth transistor (125) can be set to the ON state, and the reset voltage (Vorst) can be applied to one end of the light emitting element (130).

The transistor 125 is an example of the fifth transistor.

APPENDIX 4

In an electro-optical device (10) according to a specific aspect of any one of Aspects 1 to 3 (Aspect 4), the reset voltage (Vorst) is 0 Volt to 1 volt. According to Aspect 4, the electric charge remaining in the drain node of the first transistor (121) can be reset by the application of such a reset voltage (Vorst).

APPENDIX 5

In an electro-optical device (10) according to the specific aspect of any one of Aspects 1 to 4 (Aspect 5), a sixth transistor (67) is provided between the data line (14*b*) and a feed line (118) that supplies the reset voltage (Vorst), and in plan view, the sixth transistor (67) is disposed outside a display region (100) in which the light emitting element (130) is provided.

According to Aspect 5, since the sixth transistor (67) is provided outside the display region (100) instead of the pixel circuit (110), the complexity of the configuration can be suppressed.

The transistor 67 is an example of the sixth transistor.

APPENDIX 6

In an electro-optical device (10) according to a specific aspect of Aspect 5 (Aspect 6), the sixth transistor (67) is an N-channel type. According to Aspect 6, the voltage of the data line (14*b*) quickly reaches the reset voltage (Vorst) of a low voltage as compared to a configuration in which the sixth transistor (67) is a P-channel type.

APPENDIX 7

An electronic apparatus (300) according to Aspect 7 includes the electro-optical device (10) according to any one of Aspects 1 to 6. According to the electronic apparatus (300) according to Aspect 7, black floating can be suppressed, and a reduction in display quality can be suppressed.

APPENDIX 8

The electro-optical device (10) according to Aspect 1 can be represented as a method for driving an electro-optical device (10) as in Aspect 8. That is, the method for driving an electro-optical device (10) according to Aspect 8 is a method for driving an electro-optical device (10) which includes a pixel circuit (110) provided corresponding to a scanning line (12) and a data line (14*b*), and a transistor (121) and a light emitting element (130) included in the pixel circuit (110), the transistor (121) being able to supply a current (Iel) in accordance with a voltage (Vgs) between a gate node of the transistor (121) and a source node of the transistor (121) to the light emitting element (130), wherein a horizontal scanning period (H) includes a compensation period (D), a writing period (E), and a discharge period (F) in order, in the compensation period (D), the gate node of the transistor (121) and a drain node of the transistor (121) are electrically coupled, and a voltage of the gate node of the transistor (121) is set to a voltage (Vel−Vth) corresponding to a threshold voltage of the transistor (121), in the writing period (E), the voltage of the gate node of the transistor (121) is changed from the voltage (Vel−Vth) corresponding to the threshold voltage by a voltage corresponding to luminance of the light emitting element (131), in the discharge period (F), a reset voltage (Vorst) is applied to the drain node of the transistor (121) via the data line (14*b*), and in a light emission period (G) after the discharge period (F), the current (Iel) in accordance with to the voltage (Vgs) between the gate node of the transistor (121) and the source node of the transistor (121) is applied to the transistor (121) and the light emitting element (130).

What is claimed is:

1. An electro-optical device, comprising:

a pixel circuit provided corresponding to a scanning line and a data line; and a first transistor and a light emitting element included in the pixel circuit, wherein the first transistor is configured to supply a current corresponding to a voltage between a gate node of the first transistor and a source node of the first transistor to the light emitting element, a horizontal scanning period includes a compensation period, a writing period, and a discharge period in this order, in the compensation period, the gate node of the first transistor and a drain node of the first transistor are electrically coupled, and a voltage of the gate node of the first transistor is set to a voltage corresponding to a threshold voltage of the first transistor, in the writing period, the voltage of the gate node of the first transistor is changed from the voltage corresponding to the threshold voltage by a voltage corresponding to luminance of the light emitting element, in the discharge period, a reset voltage is applied to the drain node of the first transistor via the data line, and in a light emission period after the discharge period, the first transistor supplies a current corresponding to the voltage between the gate node of the first transistor and the source node of the first transistor to the light emitting element.

2. The electro-optical device according to claim 1, wherein the pixel circuit includes a second transistor, a third transistor, and a fourth transistor, the second transistor is provided between the data line and the gate node of the first transistor and is in an ON state or an OFF state in accordance with a voltage of the scanning line, the third transistor is provided between the data line and the drain node of the first transistor, the fourth transistor is provided between the drain node of the first transistor and the light emitting element, in the compensation period, the second transistor and the third transistor are in the ON state, in the writing period, the second transistor is in the ON state, and the third transistor is in the OFF state, in the discharge period, the second transistor is in the OFF state, and the third transistor is in the ON state, and in the light emission period, the second transistor and the third transistor are in the OFF state, and the fourth transistor is in the ON state.

3. The electro-optical device according to claim 1, wherein the pixel circuit includes a second transistor, a third transistor, a fourth transistor, and a fifth transistor, the second transistor is provided between the data line and the gate node of the first transistor and is in an ON state or an OFF state in accordance with a voltage of the scanning line, the third transistor is provided between the data line and the drain node of the first transistor, the fourth transistor is provided between the drain node of the first transistor and the light emitting element, the fifth transistor is provided between one end of the light emitting element and a feed line that supplies the reset voltage, in the compensation period, the second transistor and the third transistor are in the ON state, in the writing period, the second transistor is in the ON state, and the third transistor is in the OFF state, in the discharge period, the second transistor is in the OFF state, and the third transistor is in the ON state, in the light emission period, the second transistor and the third transistor are in the OFF state, and the fourth transistor is in the ON state, and in a period before the light emission period, the fifth transistor is in the ON state.

4. The electro-optical device according to claim 1, wherein the reset voltage is 0 volt to 1 volt.

5. The electro-optical device according to claim 1, comprising a sixth transistor between the data line and a feed line that supplies the reset voltage, wherein, in plan view, the sixth transistor is disposed outside a display region in which the light emitting element is provided.

6. The electro-optical device according to claim 5, wherein the sixth transistor is an N-channel type.

7. An electronic apparatus comprising the electro-optical device according to claim 1.

8. A method for driving an electro-optical device including a pixel circuit provided corresponding to a scanning line and a data line, and a transistor and a light emitting element included in the pixel circuit, wherein the transistor is configured to supply a current corresponding to a voltage between a gate node of the transistor and a source node of the transistor to the light emitting element, and wherein a horizontal scanning period includes a compensation period, a writing period, and a discharge period in this order, in the compensation period, the gate node of the transistor and a drain node of the transistor are electrically coupled, and a voltage of the gate node of the transistor is set to a voltage corresponding to a threshold voltage of the transistor, in the writing period, the voltage of the gate node of the transistor is changed from the voltage corresponding to the threshold voltage by a voltage corresponding to luminance of the light emitting element, in the discharge period, a reset voltage is applied to the drain node of the transistor via the data line, and in a light emission period after the discharge period, the transistor supplies the current corresponding to the voltage between the gate node of the transistor and the source node of the transistor to the light emitting element.

* * * * *